US010330446B2

(12) United States Patent
Rastegar et al.

(10) Patent No.: US 10,330,446 B2
(45) Date of Patent: Jun. 25, 2019

(54) COUNTERMEASURE FLARES

(71) Applicants: Jahangir S Rastegar, Stony Brook, NY (US); Richard T Murray, Patchogue, NY (US); Gretel Raibeck, Rockaway, NJ (US); Jay Poret, Sparta, NJ (US); Brandon Andreola, Lake Hiawatha, NJ (US); Andrew Zimmer, Wharton, NJ (US)

(72) Inventors: Jahangir S Rastegar, Stony Brook, NY (US); Richard T Murray, Patchogue, NY (US); Gretel Raibeck, Rockaway, NJ (US); Jay Poret, Sparta, NJ (US); Brandon Andreola, Lake Hiawatha, NJ (US); Andrew Zimmer, Wharton, NJ (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 0 days.

(21) Appl. No.: 15/646,022

(22) Filed: Jul. 10, 2017

(65) Prior Publication Data

US 2017/0314896 A1 Nov. 2, 2017

Related U.S. Application Data

(63) Continuation of application No. 13/971,831, filed on Aug. 20, 2013, now Pat. No. 9,702,670.

(60) Provisional application No. 61/691,774, filed on Aug. 21, 2012.

(51) Int. Cl.

| | |
|---|---|
| ***F42B 4/26*** | (2006.01) |
| ***F41J 2/00*** | (2006.01) |
| ***F41J 2/02*** | (2006.01) |
| ***F42B 10/14*** | (2006.01) |
| ***F42B 10/16*** | (2006.01) |
| ***F42B 10/26*** | (2006.01) |
| ***F42B 15/00*** | (2006.01) |
| ***F42B 15/10*** | (2006.01) |

(52) U.S. Cl.

CPC *F42B 4/26* (2013.01); *F41J 2/00* (2013.01); *F41J 2/02* (2013.01); *F42B 10/14* (2013.01); *F42B 10/16* (2013.01); *F42B 10/26* (2013.01); *F42B 15/00* (2013.01); *F42B 15/10* (2013.01)

(58) Field of Classification Search

CPC ..... F42B 4/26; F42B 15/00; F42B 15/10
USPC ..... 102/336
See application file for complete search history.

(56) References Cited

U.S. PATENT DOCUMENTS 2,977,879 A * 4/1961 Rice ..... F42B 15/00 60/201
3,782,285 A * 1/1974 Froehner ..... F42B 4/02 102/340

(Continued)

*Primary Examiner* — Samir Abdosh

(57) ABSTRACT

A flare including: a casing; and a grain assembly, at least a portion of the grain assembly being slidably disposed in the casing, the grain assembly including: a shell structure; and a grain component at least partially disposed in the shell structure, the grain component including at least one combustible material and at least one reactive material positioned relative to the combustible material and configured to ignite combustion of the at least one combustible material; wherein the shell structure includes one or more nozzles at an aft end of the shell structure for generating a thrust resulting from ignition of the at least one combustible material.

9 Claims, 22 Drawing Sheets

(56) References Cited

U.S. PATENT DOCUMENTS

| | | | | |
|---|---|---|---|---|
| 5,866,840 | A * | 2/1999 | Briere | F42B 4/26 102/336 |
| 2006/0032391 | A1 * | 2/2006 | Brune | F42B 4/26 102/342 |
| 2013/0112099 | A1 * | 5/2013 | Widener | F42B 4/26 102/336 |
| 2015/0323296 | A1 * | 11/2015 | Rastegar | F42B 4/26 102/342 |

* cited by examiner

COUNTERMEASURE FLARES

CROSS-REFERENCE TO RELATED APPLICATIONS

This application is a Divisional application of U.S. patent application Ser. No. 13/971,831, filed on Aug. 20, 2013, now U.S. Pat. No. 9,702,670, which claims benefit to U.S. Provisional Application No. 61/691,774, filed on Aug. 21, 2012, the entire contents of each of which are incorporated herein by reference.

GOVERNMENT RIGHTS

This invention was made with government support under contract no. W15QKN-06-C-0199 awarded by the United States Army. The government has certain rights in the invention.

BACKGROUND

1. Field of the Invention

The present invention relates to countermeasure flares, and more particularly to novel flare designs and assemblies for generating desired countermeasure effects, and to methods of their designing, fabricating and using the same.

2. Prior Art

A flare is typically defined, but without limitation, as a pyrotechnic device designed to produce a luminous signal or illumination. Flares are pyrotechnic devices designed to emit intense electromagnetic radiation at wavelengths in the visible region (i.e., light), the infrared (IR) region (i.e., heat), or both, or other required regions of the electromagnetic radiation spectrum without exploding or producing an explosion. Conventionally, flares have been used for signaling, illumination, and defensive countermeasures in both civilian and military applications.

An example of a conventional flare is what may be referred to as a standard illumination flare assembly that includes a single cast or pressed flare pellet that has an outside circumference and one end inhibited from burning. These flare pellets are generally ignited on one end and burn from end-to-end. These types of standard illumination flare assemblies typically have burn times that are an order of magnitude higher than decoy flares, typically ranging from tens of seconds to one or more minutes. However, in exchange for the length of the burn time, these flares typically do not exhibit sufficient magnitudes of visual light output to distract weapons operators.

Flare assemblies are utilized in various manners as defensive countermeasures. For instance, what may be characterized as "visual" flash flares have been utilized to at least generally distract, startle, and/or "throw off" a person responsible for guiding and/or aiming a missile, such as a laser guided missile, at an object, such as a tank or an airplane. A general premise behind these visual flash flares is that enough light in the visual wavelengths will be emitted via ignition of the associated payload that a person responsible for guiding and/or aiming a missile cannot help but be distracted by the magnitude of light produced.

Other prior art flare assemblies may be utilized to distract or "confuse" an infrared guided missile's guidance system into locking in on the infrared light from the flare assembly rather than the exhaust/plume of an aircraft. In this manner, flare assemblies have been utilized to decoy infrared guided missiles at least generally away from an aircraft. Decoy flares are one particular type of flare used in military applications for defensive countermeasures. Decoy flares emit intense electromagnetic radiation at wavelengths in the infrared region of the electromagnetic radiation spectrum and are designed to mimic the emission spectrum of the exhaust of a jet engine on an aircraft.

Many conventional anti-aircraft heat-seeking missiles are designed to track and follow an aircraft by detecting the infrared radiation emitted from the jet engine or engines of the aircraft. As a defensive countermeasure, decoy flares are launched from an aircraft being pursued by a heat-seeking missile. When an aircraft detects that a heat-seeking missile is in pursuit of the aircraft, one or more decoy flares may be launched from the aircraft. The heat-seeking missile may, thus, be "decoyed" into tracking and following the decoy flare instead of the aircraft.

Currently available and conventional decoy flares are generally constructed as an elongated, usually cylindrical grain that is inserted into a casing. The casing may have a first, aft end from which the decoy flare is ignited and a second, opposite forward end from which the grain is projected upon ignition. The generally cylindrical grain can include grooves or other features that extend longitudinally along the exterior surface thereof to increase the overall surface area of the grain.

The ignition system of a decoy flare conventionally includes an impulse charge device positioned within the casing and a piston-like member positioned between the impulse charge device and the grain. The ignition system may further include a first igniter material positioned on the side of the piston-like member adjacent the impulse charge device, and a second igniter material on the side of the piston-like member adjacent the grain. This second igniter material (often referred to as "first-fire" material) may surround the grain and may be disposed within the longitudinally extending grooves of the grain.

The impulse charge device may be ignited by, for example, an electrical signal. Upon ignition, the expanding gasses generated by the ignition of the charges would force the piston-like member and the grain out from the second end of the casing. The piston-like member may include a mechanism that causes or allows the first igniter material to ignite combustion of the second igniter material after the piston-like member and the grain have been deployed from the casing by the impulse charge device. The combustion of the second igniter material generally ignites combustion of the grain itself.

FIGS. 1A and 1B illustrate an example of a prior art flare 10. The flare 10 includes a grain assembly 20 shown in FIG. 1B, which is disposed within a casing 12. The grain assembly 20 includes a grain 22 of combustible material and a reactive foil 24 that is positioned relative to the grain 22 and configured to ignite combustion of the grain 22 upon ignition of the reactive foil 24. The reactive foil 24 may include alternating layers of different materials that are configured to react with one another in an exothermic chemical reaction upon ignition, which exothermic chemical reaction may be used to ignite combustion of the grain 22.

The flare 10 may be configured as a decoy flare, and the combustible material of the grain 22 may be configured to emit electromagnetic radiation upon combustion of the grain 22 with peak emission wavelength within the infrared region of the electromagnetic radiation spectrum. The flare 10 may be configured for signaling, illumination, or both, and may be configured to emit a peak emission wavelength within the visible region of the electromagnetic radiation spectrum. The flare 10 may be configured to emit a peak emission wavelength within the ultraviolet region of the electromagnetic radiation spectrum.

As shown in FIGS. 1A and 1B, both the grain 22 of the grain assembly 20 and the casing 12 may have an elongated shape. The casing 12 may have a first, aft end 14 and a second, opposite forward end 16. An impulse charge device 30 may be provided at or within the first end 14 of the casing 12 or may be coupled to the flare 10 when the flare 10 is ready to be deployed or mounted on the intended platform. The impulse charge device 30 may be configured to force the grain assembly 20 out from the second end 16 of the casing 12 upon ignition of the impulse charge device 30. As shown in FIG. 1B, the decoy flare 10 may include a piston member 32 disposed within the casing 12 between the impulse charge device 30 and the grain assembly 20. The grain 22 may include an aft end 23A and a forward end 23B. The flare 10 may further include an end cap 40 proximate to the forward end 23B of the grain 22. The grains 22 are generally cylindrical in shape with rectangular or circular cross-section, and are generally provided with a circular bore and grooves of certain shape on their exterior surfaces along the length of the grain.

In certain flares, the piston member 32 may be part of an ignition assembly (often referred to in the art as an "ignition sequence assembly," a "safe and arm igniter," or a "safe and arm ignition assembly"). In certain cases, the flare 10 may include an ignition assembly having a mechanism configured to prevent ignition of the reactive foil 24 and the grain 22 until the grain assembly 20 has been substantially ejected from the casing 12 by the impulse charge device 30. In other cases, the flare 10 may include an ignition assembly that is configured to cause ignition of the reactive foil 24 and the grain 22 before the grain assembly 20 has been substantially ejected from the casing 12 by the impulse charge device 30, or as the grain assembly 20 is being ejected from the casing 12 by the impulse charge device 30. For example, the ignition assembly may include a pellet 34 of combustible material that is attached or coupled to the piston member 32. The pellet 34 may include, for example, a boron- or magnesium-based material. Combustion of the pellet 34 may be initiated upon ignition of the impulse charge device 30, and combustion of the pellet 34 may cause ignition of the grain assembly 20.

FIG. 2 is a cross-sectional view of the grain assembly 20 of the flare 10 shown in FIGS. 1A and 1B taken along section line 4-4 in FIG. 1B. As shown in FIG. 2, in some flares, at least a portion of the reactive foil 24 may be in direct physical contact with and cover at least a portion of the grain 22. In these flares, the reactive foil 24 is in direct physical contact with at least a portion of at least one exterior lateral surface 28 of the grain 22. Furthermore, the reactive foil 24 may not be in direct physical contact with exterior lateral surfaces 28 of the grain 22 that define the grooves 26. In other flares, the reactive foil 24 may be in direct physical contact with and cover each exterior lateral surface of the grain 22 or alternatively the reactive foil 24 may not be in direct physical contact with any surface of the grain 22, but merely positioned proximate to the grain 22 such that combustion of the reactive foil 24 ignites combustion of the grain 22.

SUMMARY

Due to the important nature of their uses, aerial flares require a high degree of reliability in their ignition systems. The flare must not prematurely ignite, which can cause damage to the platform from which the flare is being released (a platform can be, for instance, but without limitation, a stand, an aircraft, a ship, a submarine, a land vehicle, and the like). The consistency of flare ejection velocity and trajectory pattern is also important for their effectiveness. Flares must also be designed such that they can be safely fabricated and used without detrimentally affecting their reliability.

In addition, it is highly desirable that the ejected flare could be provided with the capability of following certain prescribed trajectories following ejection. To achieve this goal, the ejected flair is required to be provided with certain means of propulsion.

In addition, it is highly desirable for the ejected flare to be provided with the means of achieving desired patterns of gas dispersion for the purpose of creating specifically shaped clouds of countermeasures to maximize their effectiveness.

In addition, it is highly desirable that the flare could be provided with the capability of accommodating multiple flare pyrotechnic and other materials which are assembled in different side-by-side along the length of the flare or in a multi-stage configuration or their combination and which are ignited and/or released simultaneously or in a sequential manner with or without time delay. Flare construction with multiple flare pyrotechnic and other material compositions that are assembled in any one of the above configurations is sometimes required to achieve infrared (IR) as well as ultra-violet (UV) countermeasure capability and the desired patterns of gas dispersion to maximize their effectiveness.

A need therefore exists for reliable flares that once ejected undergo a stable flight along the desired trajectory.

A need therefore also exists for methods and means to provide flares with the capability of achieving stable motion during their flight following ejection.

A need therefore also exists for methods and means to provide flares with the capability of altering their free flight trajectory. The means provided for free flight trajectory alteration may be active and/or passive that occur at certain points during the flight.

A need also exists for methods and means to provide flares with the capability of generating various gas dispersion patterns for the purpose of creating specifically shaped clouds of countermeasures to maximize their effectiveness.

In addition, there is a need for methods for the design and fabrication of flares that could accommodate multiple flare pyrotechnic and other appropriate materials which are assembled in different side-by-side along the length of the flare or in a multi-stage configuration or their combination and which are ignited and/or released simultaneously or in a sequential manner with or without certain amount of time delay. The flare construction with multiple flare pyrotechnic and other material compositions may be required to achieve infrared (IR) as well as ultra-violet (UV) countermeasure capability and the desired patterns of gas dispersion to maximize their effectiveness.

A need also exists for safe aerial flares with highly reliable ignition systems. The flares must also operate consistently for their maximum effectiveness. The flares must also be designed such that they can be safely fabricated and used. In addition, to ensure safety, ignition system should not initiate during acceleration events which may occur during manufacture, assembly, handling, transport, accidental drops, etc.

In addition, it is highly desired that the entire flare and dispenser assembly be compact and provide a very high percentage of the total volume to flare gas cloud generating pyrotechnic and other materials used to generate them.

It is an object to provide methods and means for the design and fabrication of compact flares that will safely and reliably achieve stable and consistent flight upon ejection. The flares may also be provided with the means of propulsion and/or trajectory modification upon ejection, while maximizing the available volume for the flare pyrotechnic and other material compositions to maximize the flare effectiveness.

It is another object to provide methods for the design and fabrication of flares that could accommodate multiple flare pyrotechnic and other appropriate materials which are assembled in different side-by-side along the length of the flare or in a multi-stage configuration or their combination and which are ignited and/or released simultaneously or in a sequential manner with or without certain amount of time delay. The flare construction with multiple flare pyrotechnic and other material compositions may be required to achieve infrared (IR) as well as ultra-violet (UV) countermeasure capability and the desired patterns of gas dispersion to maximize their effectiveness.

It is yet another object to provide methods and means to design and fabricate flares with the capability of generating various gas dispersion patterns for the purpose of creating specifically shaped clouds of countermeasures to maximize their effectiveness.

It is yet another object to provide methods and means of designing and fabricating flare assemblies that are capable of maintaining structural integrity throughout normal flight movement and/or vibrations as well as normal ejection forces.

It is still another object to provide flare pellet assemblies that are capable of being tailored to replicate an exhaust plume of any of a number of appropriate aircraft. These objectives, as well as others, may be met by the countermeasure system and related methods herein described.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Figure 3:
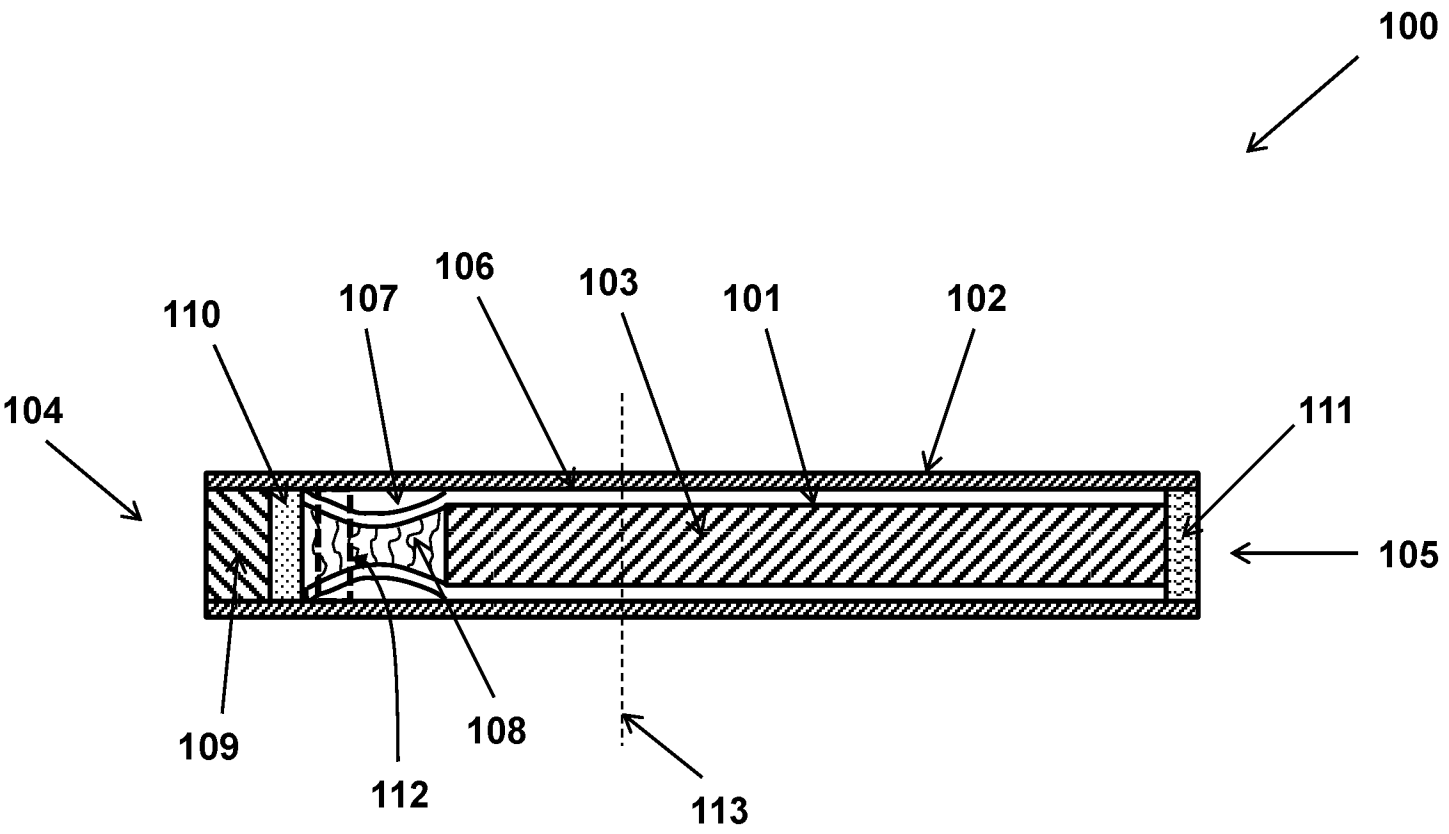
FIG. 3 is the schematic of the first embodiment of the countermeasure flare of the present invention.

FIG. 3 illustrates the schematic of the longitudinal cross-sectional view of a first embodiment 100 of a flare 100. The flare 100 includes a grain assembly 101 which is disposed within a casing 102. The casing 102 may have a first, aft end 104 and a second, opposite forward end 105. The grain assembly 101 includes the grain component 103, which consists of at least one combustible material and at least one reactive material which is positioned relative to the combustible material and configured to ignite combustion of the at least one combustible material. The grain assembly 101 is provided with a shell structure 106, which encases at least a portion of the grain component 103 of the grain assembly 101. The grain component 103 may also include at least one non-combustible material that is added to achieve certain effects such as generation and/or intensification of electromagnetic radiation at the desired wavelengths.

The flare 100 may be configured as a decoy flare, and the combustible material(s) of the grain component 103 may be configured to emit electromagnetic radiation with peak emission wavelength within the infrared region of the electromagnetic radiation spectrum and/or other spectrum(s) upon combustion of the combustible material(s) of the grain component 103 and interaction of the other said added noncombustible material(s), if present. The flare 100 may be configured for signaling, illumination, or both, and may be configured to emit at least a peak emission wavelength within the visible region of the electromagnetic radiation spectrum. The flare 100 may be configured to emit at least a peak emission wavelength within the ultraviolet region of the electromagnetic radiation spectrum.

Figure 1A:
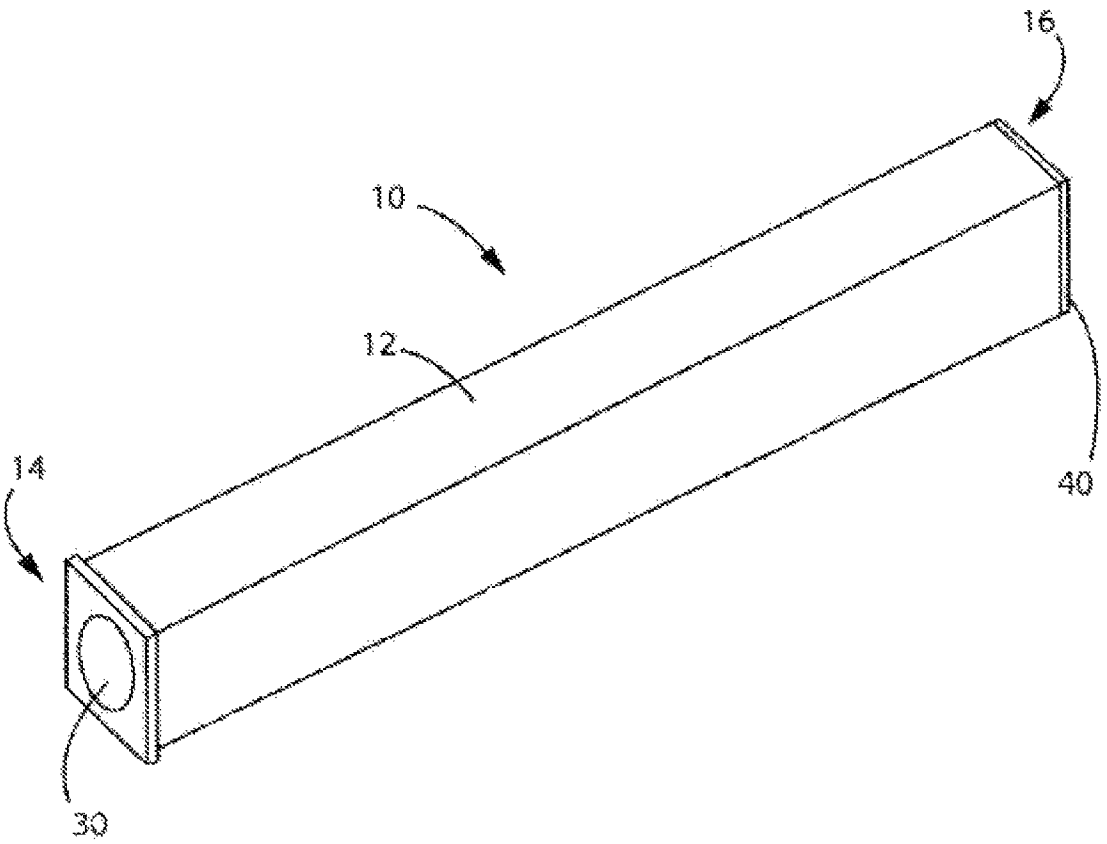
Figure 1A (PRIOR ART)
FIG. 1A illustrates the schematic of a perspective view of a flare of the prior art.
Figure 1B:
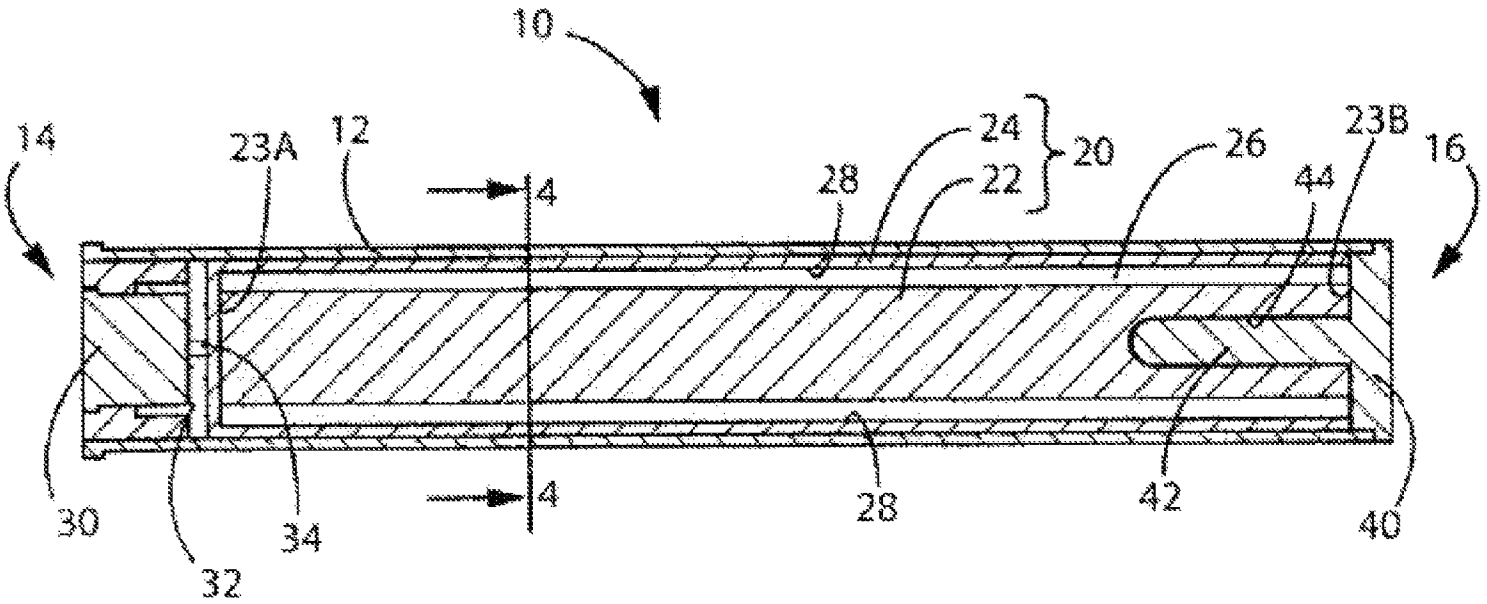
Figure 1B (PRIOR ART)
FIG. 1B illustrates a cross-sectional view of the prior art flare of FIG. 1A.
Figure 2:
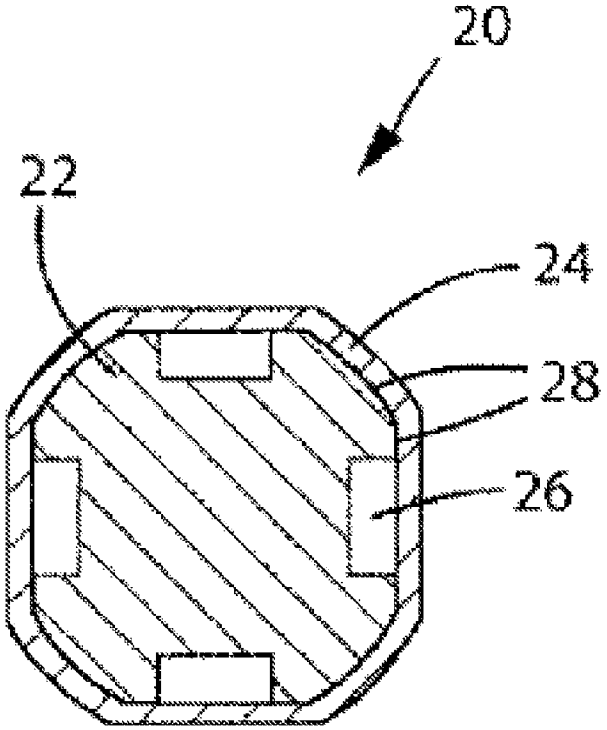
Figure 2 (PRIOR ART)
FIG. 2 illustrates the cross-sectional view 4-4 of the prior art flare of FIGS. 1A and 1B.

As shown in the cross-sectional view of FIG. 3, both the grain component 103 and the grain assembly 101 and the casing 102 may have an elongated shape with essentially constant cross-sectional area, which may be almost of any shape, such as rectangular (as shown for the prior art flare shown in FIGS. 1A, 1B and 2) or circular. In general, the cross-sectional area can be selected to be square and not circular when it is desired to pack as many such flares as possible in as small a volume as possible.

On its aft end 104, the shell structure 106 of the grain assembly 101 is formed into a nozzle section 107. The interior volume of the nozzle section 107 is preferably filled with at least one material composition 108, which may be composed of the same grain component 103; or may at least partly include certain appropriate propellant material; or may be composed of at least certain pyrotechnic material that is used to initiate ignition of the grain component 103 of the flare and at the same time generate a thrust in the direction of launching the grain assembly 101 from inside the flare casing 102.

The nozzle section 107 may be designed with the usual converging section that is connected via a throat section to the diverging section (aft section of the nozzle 107 as seen in FIG. 3), where the accelerated gasses exit at relatively high speeds. The length of each section and the throat diameter ratio are selected to achieve the desired effects as described below.

An impulse charge device 109 may be provided at or within the first end 104 of the flare casing 102 or may be coupled to the flare 100 when the flare 100 is ready to be deployed or mounted on the intended platform. The impulse charge device 109 may be configured to force the grain assembly 101 out from the second end 105 of the casing 102 upon ignition of the impulse charge device 109. The flare 100 may be provided with a piston member 110 which is disposed within the casing 102 between the impulse charge device 109 and the grain assembly 101. The piston member 110 is used to provide a sealing action to allow the pressurized gasses generated by the initiation of the impulse charge device 109 to effectively act on the grain assembly 101 and eject it from the second end 105 of the casing 102. The flare 100 may be provided with an end cap 111, preferably to seal the grain assembly inside the casing 102.

As can be seen in the embodiment 100 of FIG. 3, a separate piston member 110 is used as a seal to allow the pressurized gasses generated by the initiation of the impulse charge device 109 to propel the grain assembly 101 and eject it from the second end 105 of the casing 102. It is, however, appreciated by those skilled in the art that the "piston" may be formed around at least a portion of the length of the nozzle 107 as shown in FIG. 3 by dashed lines and indicated by the numeral 112, thereby allowing more space for the grain component 103. It is also appreciated by those skilled in the art that at least a portion of the aft expanding portion of the nozzle could be used to form the impulse charge device 109, in which case the aft end 104 of the flare casing needs to be securely closed with a closing member (not shown), preferably as an integral part of the casing 102, to allow the pressurized gasses generated by the initiation of the impulse charges to effectively accelerate and eject the grain assembly 101.

In the flair embodiment 100 shown in FIG. 3, the shell structure 106 is used to encase the entire length of the grain component 103 of the grain assembly 101. In this design, upon ejection, the flare component 103 would burn primarily from its aft end since it is otherwise encased in the shell structure 106 and the generated gasses are discharged through the nozzle 107, thereby generating certain level of thrust that could be used to propel the grain assembly along its path of travel (trajectory). This embodiment has the advantage of providing a relatively long flare burn time (and the forward thrust), but due to its limited burn surface of the grain component, the amount of gasses and illumination that it can produce is relatively limited. To achieve the same level of nozzle 107 generated thrust while significantly increasing the burning rate (burning surface area), the following modifications can be made to the embodiment 100 shown in FIG. 3.

A first modification consists of providing openings on the surface of the shell structure 106 of the grain component 103, starting certain distance from the side of the nozzle 107, for example from the dashed line 113 to the forward end 105, to provide larger exposed burn areas for the grain component 103 (the method of igniting the exposed surfaces to be described below).

A second modification consists of totally eliminating the shell structure 106 from the dashed line 113 to the forward end 105, thereby exposing the entire surface of this section (from the dashed line 113 to the forward end 105) of the grain component 103 to combustion. It is appreciated by those skilled in the art that the exposed section of the grain component 103 could cover a very large portion of the length of the grain component 103, and thereby allow a significant increase in the rate of burning of the grain component 103, particularly if measures are taken to increase the outer surface area of the grain component 103 as, for example, shown in FIG. 2.

It is noted that in the embodiment 100 of FIG. 3, the gasses generated by the burning of the grain component 103 are accelerated through the nozzle 107 to generate forward thrust. It is, however, appreciated by those skilled in the art that if desired, the volume of the grain component 103 at and near the nozzle 107 may be filled with any type of propellant material and used to generate significantly larger nozzle 107 thrust.

It is also appreciated by those skilled in the art that layers of different pyrotechnic compositions and/or materials and/or combinations/mixtures may be used to fill the interior volume of the nozzle section 107 and/or make the grain component 103 itself with such layered materials so that different exhaust gasses are dispersed in a sequential manner and with different patterns (while also making it possible to vary the thrust generated by the nozzle 107) to achieve the desired flare countermeasure effects, including the generation of intermittent forward thrust.

Figure 4:
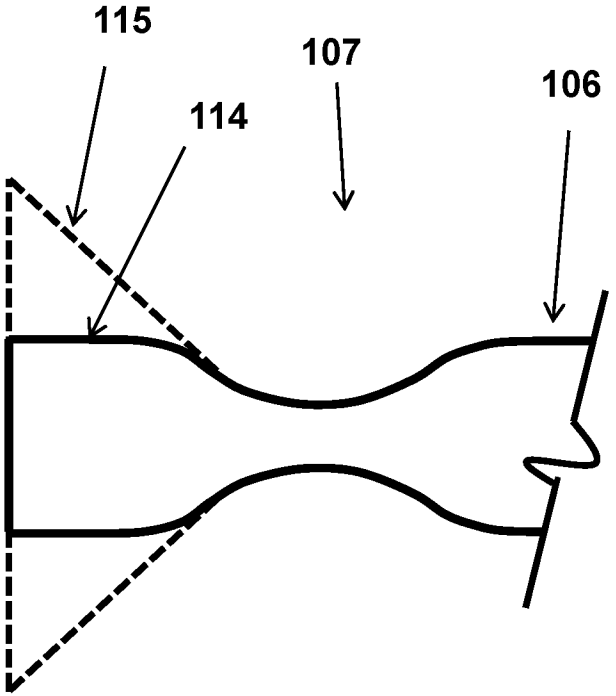
FIG. 4 is the schematic of one alternative nozzle section design for the first embodiment of the countermeasure flare of FIG. 3.

In the flare embodiment 100 shown in FIG. 3, the nozzle 107 is considered to have a fixed geometry. As a result, the geometry of the nozzle, and particularly the size of the expanding (exhaust) section is limited by the shape and area of the cross-sectional area of the casing 102. In an alternative embodiment of the flare 100, the nozzle 107 is designed to be "collapsible" (deformable, expandable, deployable or capable of morphing), such that it is initially "collapsed" to a first geometry to fit inside the casing 102, but that would "expand" or "morph" to a second geometry following ejection from the casing 102. As an example and without implying any limitation, the expanding section of the nozzle 107 could be designed to assume the first geometry 114 shown in the partial cross-sectional view of FIG. 4 and subsequent to ejection from the casing 102 to assume the second geometry 115 shown in dashed lines, thereby significantly increasing the diverging section of the nozzle 107. The different methods and means of achieving the "collapsible" (deformable, expandable, deployable or capable of morphing) nozzles will be described below.

In the flare embodiment 100 shown in FIG. 3, a single the nozzle 107 with fixed geometry is considered to be used. In an alternative embodiment of the flare 100, more than one individual nozzle (collectively indicated as the nozzle section 116 in the schematic of FIG. 5) are instead used. In the cross-sectional view of FIG. 5, the nozzle section 116 is shown to consist of two separate nozzles 117 and 118 which are symmetrical in the plane of the cross-section. However, it is appreciated by those skilled in the art that more than two separate nozzles of different shapes and cross-sections and non-symmetric may also be employed, which could also provide different advantageous and operational functionality to the resulting countermeasure flares as will be described below.

Figure 5:
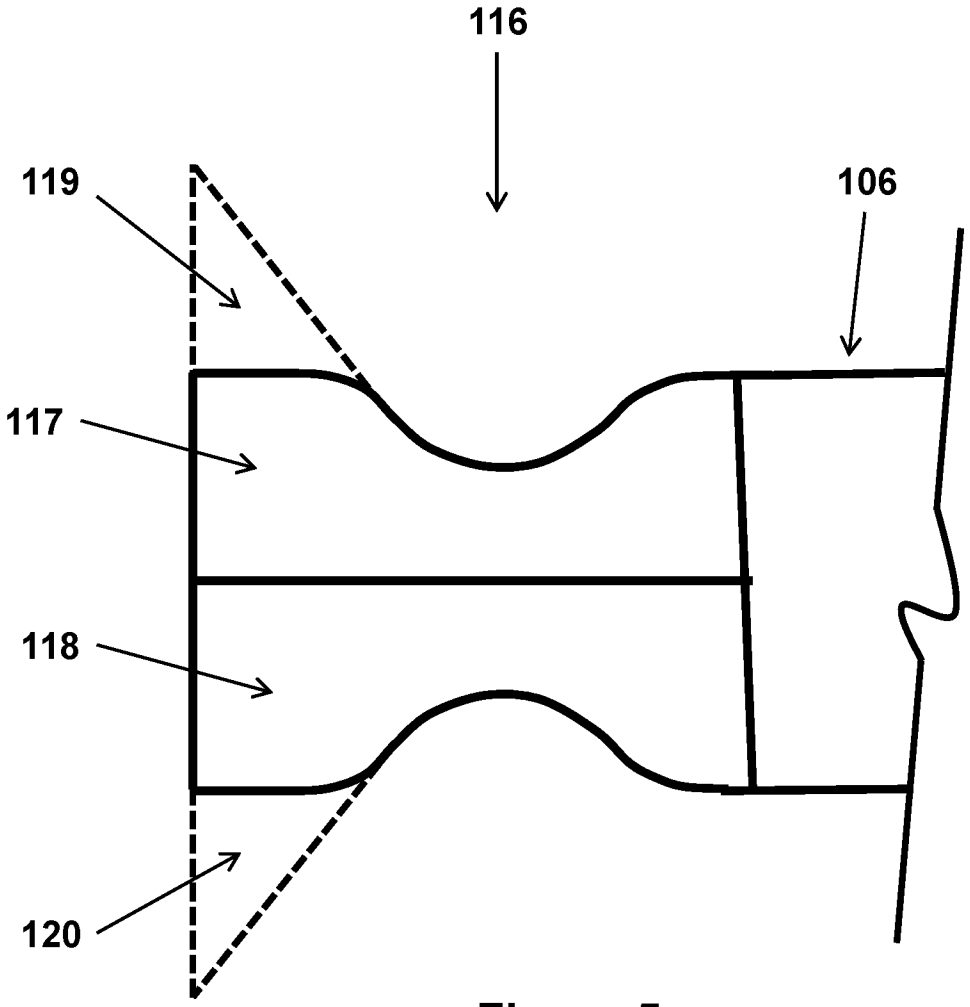
FIG. 5 is the schematic of another alternative nozzle section design for the first embodiment of the countermeasure flare of FIG. 3.

In addition, one or more of the nozzles provided in the nozzle section 116, FIG. 5, may be provided with the aforementioned feature of being "collapsible" (deformable, expandable, deployable or capable of morphing), such that they are initially "collapsed" to a first geometrical configuration (shown in solid lines in FIG. 5 for the nozzles 117 and 118) to fit inside the casing 102, but that would "expand" or "morph" to a second geometrical configuration (shown with dashed lines for the nozzles 117 and 118 and enumerated as 119 and 120, respectively) following ejection from the casing 102.

Figure 6B:
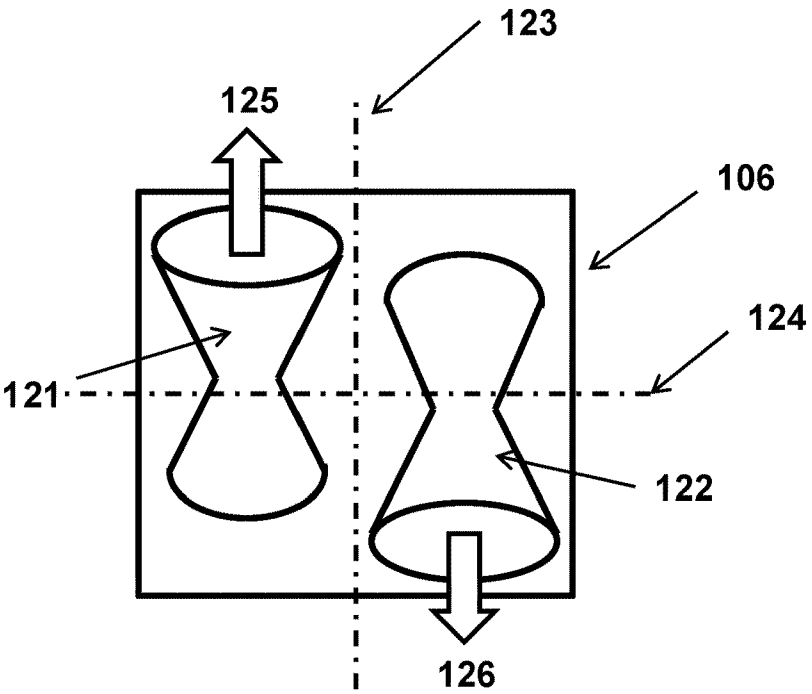
FIGS. 6A and 6B illustrate another alternative nozzle section design for the first embodiment of the countermeasure flare of FIG. 3.
Figure 6A:
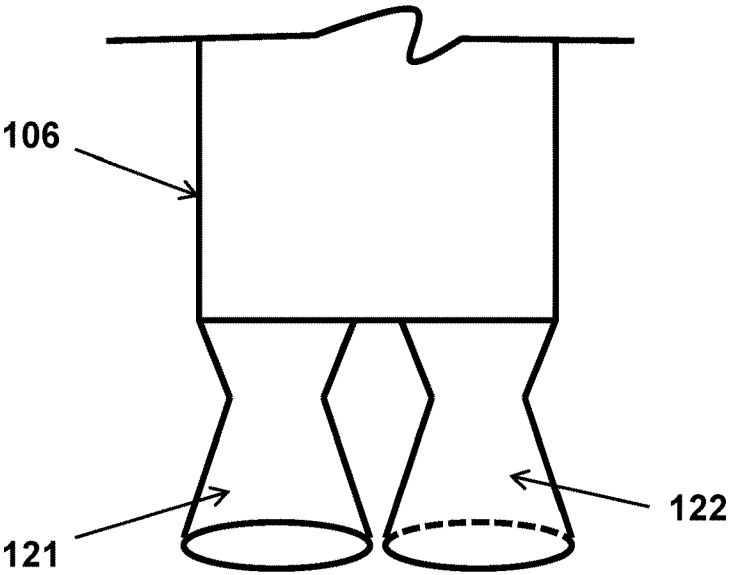

It is appreciated by those skilled in the art that in the flare embodiment 100 and its various aforementioned variations as well as those to be described below, the geometry of the nozzles (i.e., the shape and size of their cross-sectional area along the length of the converging, diverging and throat sections of the nozzle) may be symmetrical or non-symmetrical and of arbitrary shape to achieve the desired gas dispersion pattern and/or thrust and/or spinning torque. For example, to achieve a spinning torque about the long axis of the flare, at least two identical nozzles 121 and 122 may be positioned as shown in the schematic of FIG. 6 of the aft section of the ejected flare. It is noted that the nozzles 121 and 122 shown in FIGS. 6A and 6B are considered to be "collapsible" (deformable, expandable, deployable or capable of morphing), such that they are initially "collapsed" to a first geometrical configuration to fit inside the casing 102, FIG. 3, but that would "expand" or "morph" to a second geometrical configuration 121 and 122 shown in FIGS. 6A and 6B as was described for the embodiments of FIGS. 4 and 5. The nozzles 121 and 122 are positioned symmetrically about the long axis of the flare shell structure 106 as indicated by the (intersection of the) centerlines 123 and 124. The nozzles 121 and 122 are also are positioned at an identical angles relative to the plane of the centerlines 123 and 124, so that the net thrust generated accelerated gasses exiting the said nozzles and indicated by the arrows 125 and 126, respectively, in FIG. 6B, are also directed at the same angles relative to the plane of the centerlines 123 and 124. As a result, the two nozzles 121 and 122 would essentially generate a total of thrust in the direction of the long axis of the flare 100 as well as a net torque (couple) about the said long axis of the flare.

It is appreciated by those skilled in the art that by providing the aforementioned at least two nozzles 121 and 122, FIGS. 6A and 6B, the ejected flare is provided with a net thrust in the direction of its long axis, while being provided with a net toque (couple) that would tend to spin the flare about its long axis, thereby providing the ejected flare with the capability of achieving flight stability.

It is also appreciated by those skilled in the art that by using one or more nozzles with symmetrical or arbitrary cross-sectional areas, which are positioned and oriented symmetrically or non-symmetrically about the long axis of the fare, and by providing propellants that consist of grain component 103 and/or pyrotechnics and/or other materials, the flare nozzle "system" can be used to perform many different functions, including one or more of the following:

1. To generate thrust, and/or
2. Cause the flare to spin by providing a spinning couple to it, and/or
3. Cause the exhaust gasses to disperse with certain pattern along the flare trajectory, or
4. Achieve any combination of the above effects.

As it can be observed in the schematic of the embodiment 100 of FIG. 3, within the section of the casing 102 where the nozzle 107 is located, there is a gap between the outer surfaces of the nozzle 107 and the inner surface of the casing 102. It is appreciated by those skilled in the art that it is highly desirable to utilize all the available space within a flare (casing 102) volume. The following nozzle section embodiments are developed to allow the flare designer to provide a flare with at least one nozzle as previously described, while at the same time convert essentially the entire aforementioned gap between the outer surface(s) of the nozzle(s) 107 and casing 102 into a usable space.

Figure 7:
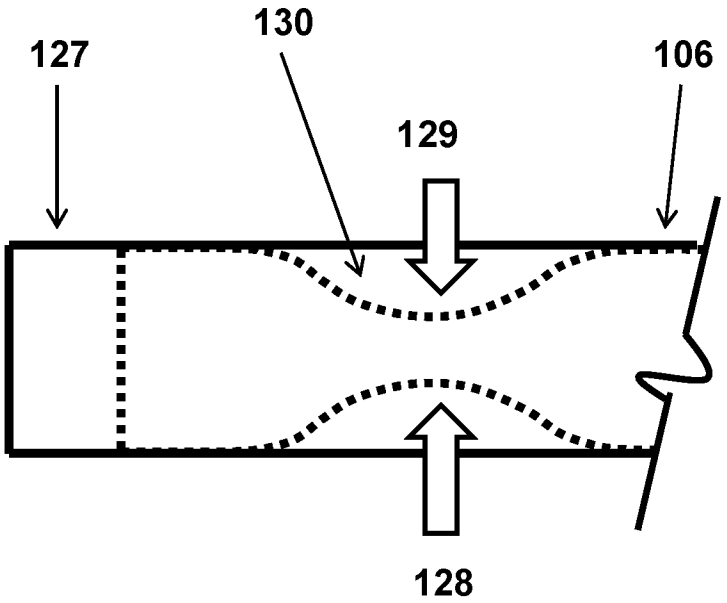
FIG. 7 illustrates another alternative nozzle section design for the first embodiment of the countermeasure flare of FIG. 3.

The first such nozzle section embodiment is shown in the schematic of FIG. 7. In this embodiment, the nozzle section in its pre-ejection configuration 127 has essentially the same cross-sectional area and shape, hereinafter referred to as the first configuration 127, as the shell structure 106 of the grain assembly 101 to which it is attached. As a result, the entire volume inside the flare 100 in the nozzle section can be filled with grain component 103 and/or pyrotechnics and/or other materials prior to ejection. Then upon flare ejection, as the nozzle fill (grain component 103 and/or pyrotechnics and/or other materials) is burned, the nozzle section walls deform from its initial shape (aforementioned first configuration 127) to its nozzle shape (second configuration) shown by dashed lines in FIG. 7 and indicated by the numeral 130. In general, the transformation of the nozzle section "walls" from the first configuration 127 to the second configuration 130 is accomplished by initially forming the nozzle walls in shape of their second configuration 130, and then elastically deforming the walls to their aforementioned first configuration 127, and keeping them in their said first configuration by the nozzle fill (grain component 103 and/or pyrotechnics and/or other materials). Then as the nozzle fill is burned, the nozzle walls would deform in the direction of the arrows 128 and 129 shown in FIG. 7, and transform the nozzle to its second configuration 130. Such configuration transforming nozzle sections may be designed in a number of ways, a few examples of which and without intending to restrict the present disclosure are provided below.

Figure 8B:
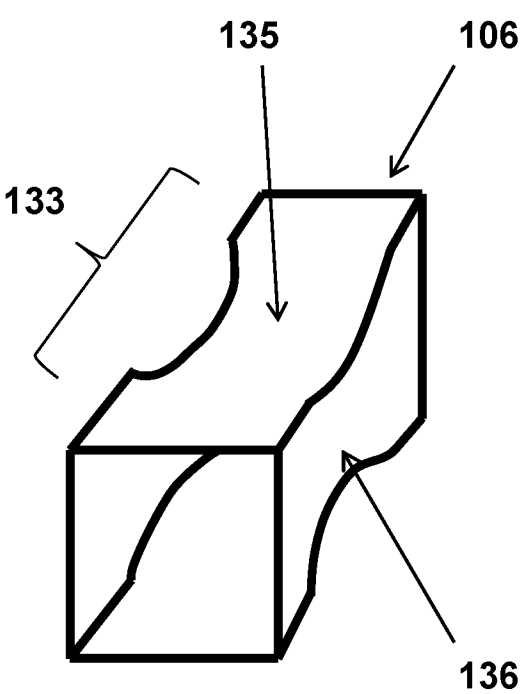
FIGS. 8A and 8B illustrates another alternative nozzle section design for the first embodiment of the countermeasure flare of FIG. 3.
Figure 8A:
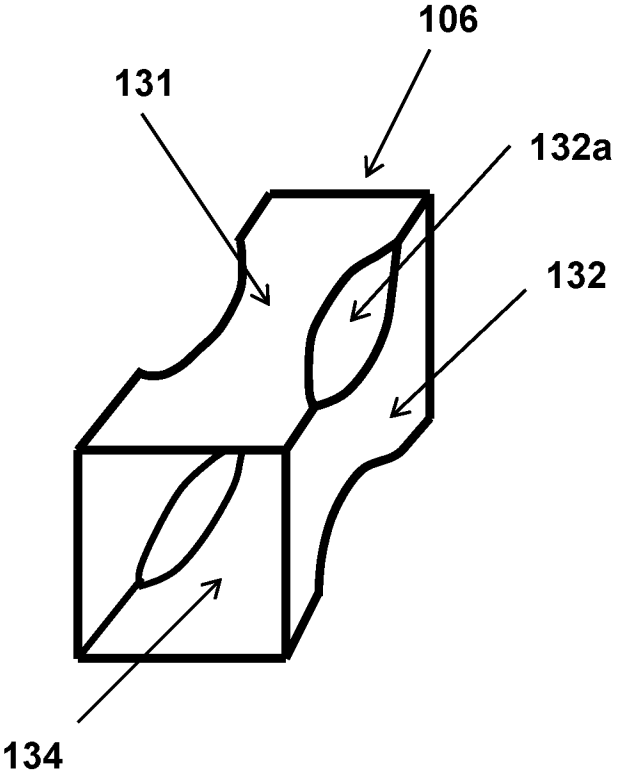

In one embodiment, shown schematically in FIGS. 8A and 8B, the aft end of the shell structure 106 of the grain assembly 101 (FIG. 3) is initially in the configuration shown in FIG. 8A. In this configuration, one or both of the facing side panels 131 and 132 of the nozzle section 133 are held in the configuration shown in FIG. 8A by the grain component 103 and/or other pyrotechnics and/or propellants that is used to fill the space 134 inside the nozzle section 133. The facing side panels 131 and 132 include cut outs 132*a* to allow for deformation of the facing side panels 131, 132. The one or both of the facing side panels 131 and 132 are elastically deformed to stay in the configurations of FIG. 8A. Then as the grain component 103 and/or other pyrotechnics and/or propellants that is used to fill the space 134 is burned, the one or both of the facing side panels 131 and 132 return to their unstrained configurations to close the cut outs 132*a*, as shown in FIG. 8B and enumerated by numerals 135 and 136, respectively. The nozzle section 133 would thereby form the configuration shown in FIG. 8B, thereby provide a thrust generating nozzle as the grain component 103 and/or other pyrotechnics and/or propellants filling the remaining space of the nozzle section 133 and the adjacent shell structure 106 is burned.

It is appreciated by those skilled in the art that a number of alternative methods may be used to provide the required means to force the side panels 131 and 132 from their configurations of FIG. 8A to those of 135 and 136 configurations shown in FIG. 8B with or without the aforementioned initial elastic deformation. For example, the panels 131 and 132 may be constructed with a shape memory alloy material such that once heated due to the burning of the filling grain component 103 and/or other pyrotechnics and/or propellants, the panels deform to their 135 and 136 state.

It is also appreciated by those skilled in the art that the flare 100 of FIG. 3 may have a circular or near circular (for example oval) cross-sectional area. When, for example, the cross-sectional area of the flare 100 (and its casing 102 and shell structure 106 and grain component 103) is circular, the aforementioned nozzle section geometry transformation (similar to the transformation from the configuration of FIG. 8A to that of FIG. 8B) can be achieved using a number of methods, examples of which without intending to indicate limitations, are hereby provided.

Figures 9A, 9B:
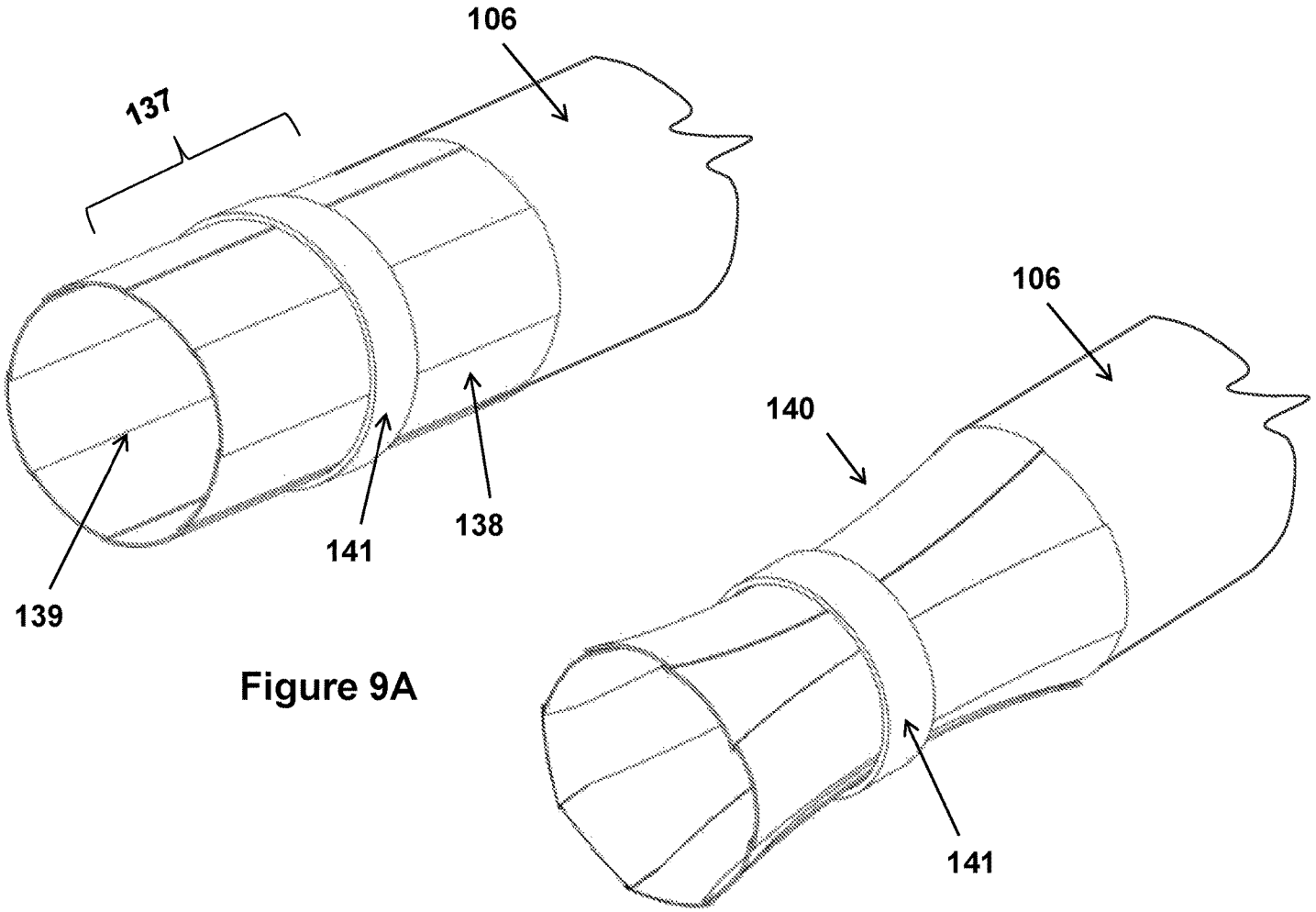
FIGS. 9A and 9B illustrates another alternative nozzle section design for the first embodiment of the countermeasure flare of FIG. 3.

One embodiment of such configuration transforming nozzles with circular or near circular cross-sectional areas is shown schematically in FIGS. 9A and 9B. In this embodiment, the nozzle section 137, which is attached to the aft end of the shell structure 106 of the grain assembly 101 (FIG. 3), is constructed with a number of flaps 138 that in their first configuration shown FIG. 9A form essentially the same cylindrical shape as the shell structure 106 of the flare 100. In this configuration, the flaps 138 are held in their (essentially straight) state by the filling grain component 103 and/or other pyrotechnics and/or propellants that are used to fill the space 139 inside the nozzle section 137. In an embodiment, flaps 138 are elastically deformed to stay in the (essentially straight) state of FIG. 9A. Then as the grain component 103 and/or other pyrotechnics and/or propellants that are used to fill the space 139 is burned, the flaps 138 return to their unstrained configurations shown in FIG. 9B and enumerated by numerals 140. The flaps 138 can be partially fluted (not shown) to provide them with strength and are overlapping to minimize leakage of the generated gasses. The nozzle section 137 would thereby form the configuration shown in FIG. 9B, to provide a thrust generating nozzle as the grain component 103 and/or other pyrotechnics and/or propellants filling the remaining space of the nozzle section 137 and the adjacent shell structure 106 is burned.

It is appreciated by those skilled in the art that at least one elastically preloaded "elastic ring" or "spring" 141 may be provided to force the flaps 138 from their essentially straight configuration shown in FIG. 9A to their configuration 140 shown in FIG. 9B. The preloaded elastic ring/spring 141 may also be used to keep the flaps in their configuration 140 as the filling grain component 103 and/or other pyrotechnics and/or propellants are burned and gas pressure builds up inside the nozzle section 137. The use of at least one elastically preloaded elastic ring/spring 141 minimizes the aforementioned required elastic deformation of the flaps 138 to their first (essentially straight) configuration, and even eliminate the need for such elastic deformation of the flaps 138 if the at least one elastic ring/spring 141 is provided with an appropriate level of preload.

In addition, the flaps 138 and/or ring 141 may be fabricated from a shape memory alloy such that once heated due to the burning of the filling grain component 103 and/or other pyrotechnics and/or propellants, the flaps 138 and/or ring 141 deform to the configuration shown in FIG. 9B.

Although the flaps 138 are shown as being cut to the ends thereof, that may also to configured as a single cylinder with longitudinal slits that define the individual flaps 138 except such slits do not need to extend all the way to the end of the cylinder.

Figure 10B:
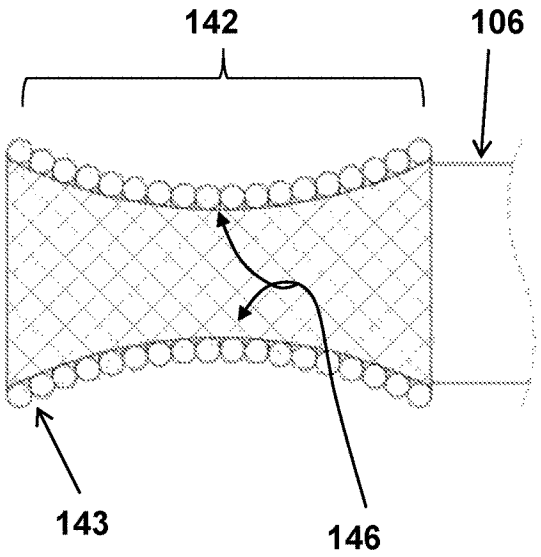
FIGS. 10A and 10B illustrates another alternative nozzle section design for the first embodiment of the countermeasure flare of FIG. 3.
Figure 10A:
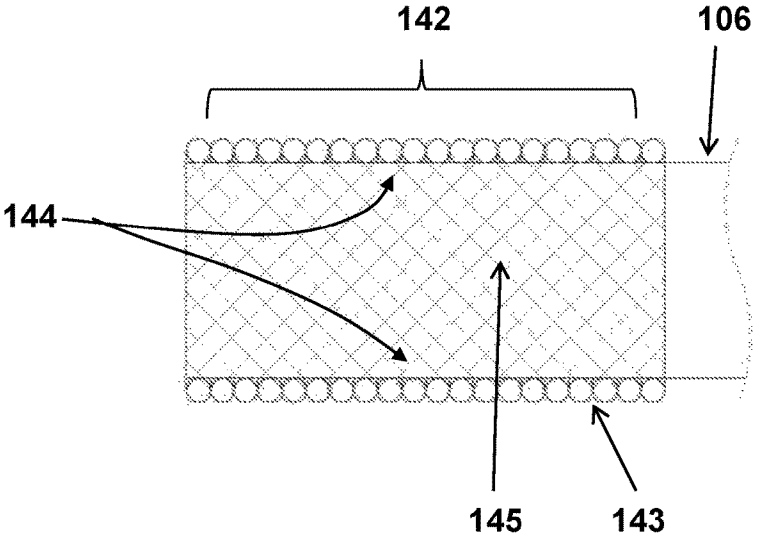

Another embodiment of such configuration transforming nozzles with circular cross-sectional area is shown schematically in FIGS. 10A and 10B. In this embodiment, the nozzle section 142, which is attached to the aft end of the shell structure 106 of the grain assembly 101 (FIG. 3), is constructed by a spring wire 143 (which can also have a rectangular cross-section) that is in its rest (second configuration) state 146 is shown in the configuration of FIG. 10B, i.e., form a nozzle with a throat area and expanding (flow accelerating) aft section. The rectangular or other similar cross-sectional area, which can also have overlapping lips, can minimize the amount of gasses that are passing through the nozzle section 142 from escaping out. In its first configuration shown in FIG. 10A, the nozzle (indicated by the numeral 144) forms essentially the same cylindrical shape as the shell structure 106 of the flare 100. The nozzle 144 is held in this first configuration by the filling grain component 103 and/or other pyrotechnics and/or propellants that are used to fill the space 145 inside the nozzle 144. In the preferred embodiment, the spring wire 143 is deformed from its rest state 146 (FIG. 10B) to its state 144 (FIG. 10A). Thereby, as the grain component 103 and/or other pyrotechnics and/or propellants that are used to fill the space 139 is burned, the spring wire 143 returns to its unstrained second configurations 146. The nozzle section 142 would thereby form the configuration shown in FIG. 10B and provide a thrust generating nozzle as the grain component 103 and/or other pyrotechnics and/or propellants filling the remaining space of the nozzle section and the adjacent shell structure 106 is burned.

It is appreciated by those skilled in the art that one may use more than one layer of overlapping (such as rectangular cross section) wires to form the nozzle section 142 shown in the embodiment of FIGS. 10A and 10B. The advantage of using more than one overlapping layers is that the internal layer could be used to minimize the amount of gasses that could escape from the sides of the nozzle, thereby increasing the amount of thrust that the nozzle can provide.

It is also appreciated by those skilled in the art that similar to the embodiment of FIGS. 9A and 9B, at least one elastically preloaded "elastic ring" or "spring" (141 in FIGS. 9A and 9B) may be provided to force the spring wire formed nozzle section from its first (essentially cylindrical) configuration 144 shown in FIG. 109A to its second configuration 146 shown in FIG. 10B. The preloaded elastic ring/spring (not shown) may also be used to keep the spring wire formed section in its configuration 146 as the filling grain component 103 and/or other pyrotechnics and/or propellants are burned and gas pressure builds up inside the nozzle section 145. The use of at least one elastically preloaded elastic ring/spring also minimizes the aforementioned required elastic deformation of the spring wire 143 to its first configuration shown in FIG. 10A, and even eliminate the need for such elastic deformation of the nozzle section spring wire 143 if the at least one elastic ring/spring (similar to the element 141 in FIGS. 9A and 9B) is provided with an appropriate level of preload.

Figure 11B:
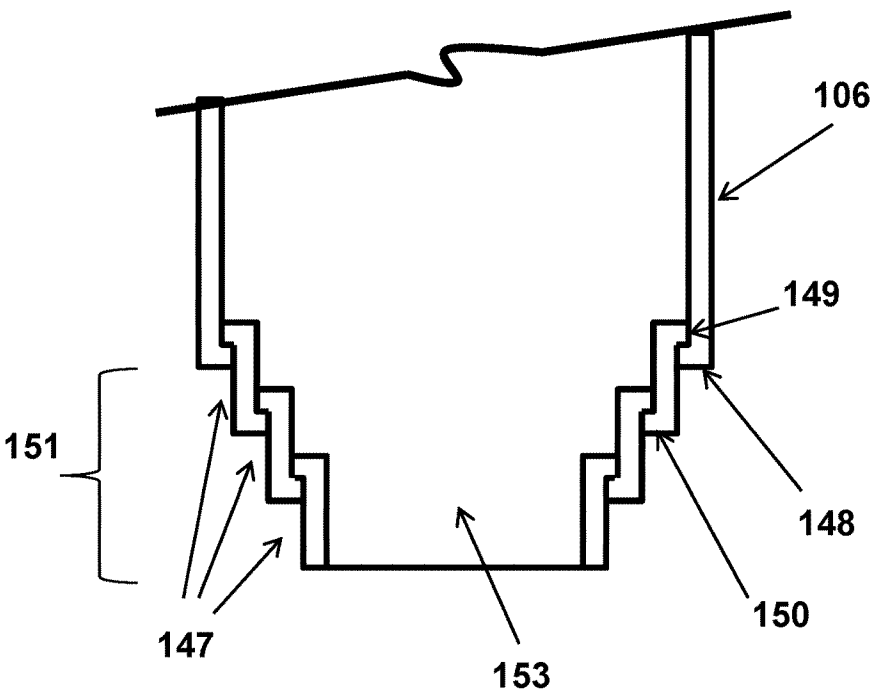
FIGS. 11A and 11B illustrates another alternative nozzle section design for the first embodiment of the countermeasure flare of FIG. 3.
Figure 11A:
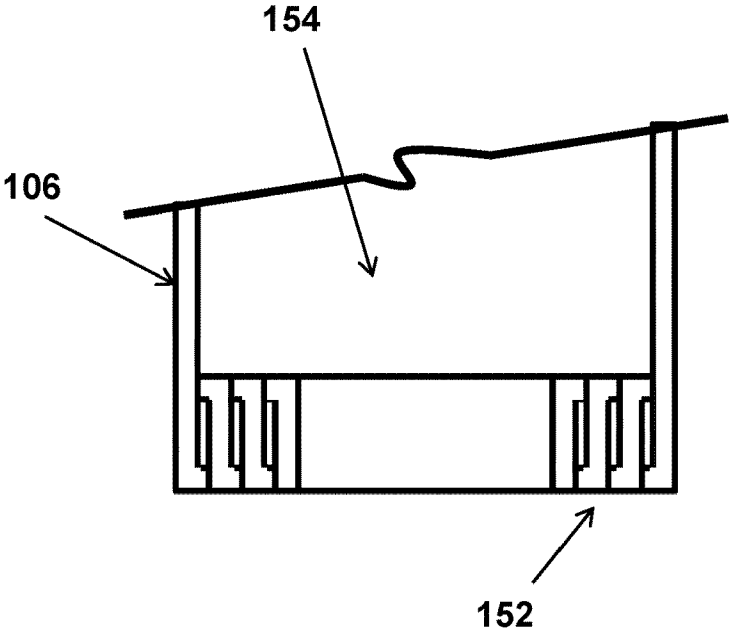

In the nozzles shown in FIGS. 3-10, the nozzle consists of a converging section, a throat section and a diverging (aft) section where the exiting gasses are accelerated. The diverging end section is provided to accelerate the gasses exiting the nozzle throat to generate higher levels of thrust. In many flare applications, the amount of thrust that is desired to be generated is, however, relatively low and can be generated with nozzles that do not have the aforementioned diverging section. Any one of the nozzles of the embodiments of FIGS. 7-10 may be constructed without a converging section. Alternatively, such nozzles may be constructed as shown in FIGS. 11A and 11B. In this embodiment, the nozzle is constructed with at least two nested rings 147 (the rings being circular or square or any other closed-loop shape) that are preferably slightly tapered along the length of the rings. The rings are initially in the packed configuration 152 as shown in FIG. 11A. The aft end of the shell structure 106 of the grain assembly 101 (FIG. 3) is provided with an inward lip 148 that would engage with the outward lip 149 of the first ring 147 as the nested rings 147 deploy outward upon the flare ejection. The first ring 147 is also provided with an inward lip 150 on its other end. Similar engaging lips are provided on all nested rings 147 so that as following flare ejection, as the nested rings 147 deploy outward, they would form the converging section of a nozzle section 151 as the inward and outward lips of the nested rings 147 are engaged as shown in FIG. 11B, and form a throat section 153. In their initial state shown in FIG. 11A, the nested rings 147 can be held in their position by strings or the like (not shown) that burn as the filling grain component 103 and/or other pyrotechnics and/or propellants in the space 153 inside the inner ring and/or the space 154 inside the shell structure above the nested rings 147 are ignited. The gas pressure generated by the ignited material in the space 154 will force the deployment of the nested rings 147 to their configuration shown in FIG. 11B and their maintenance in the deployed configuration. It is however appreciated by those skilled in the art that appropriate preloaded spring elements (not shown) may also be provided between each pair of rings 147 to assist in the deployment of the rings to their configuration of FIG. 11B.

In the embodiment of FIGS. 11A and 11B, the rings 147 are individual rings that are nested as shown in these figures and deploy upon ejection and ignition of the grain component 103 and/or other pyrotechnics and/or propellants filling the spaces 153 and 154, FIGS. 11A and 11B. In an alternative embodiment, the rings 147 may be a continuously wound band of spring material with the indicated lips 149 and 150, which are wound as a helical spring commonly used in so-called power springs, which are well known in the art. The helical spring can be biased to stay in the configuration of FIG. 11B, and is held similarly in its pre-ejection configuration of FIG. 11A by strings or the like (not shown) that burn as the filling grain component 103 and/or other pyrotechnics and/or propellants in the space 153 inside the inner turn of the helical spring and/or the space 154 inside the shell structure above the helical spring are ignited. The gas pressure generated by the ignited material in the space 154 will force the deployment of the helical spring to configuration shown in FIG. 11B and their maintenance in the said deployed configuration.

Figure 12B:
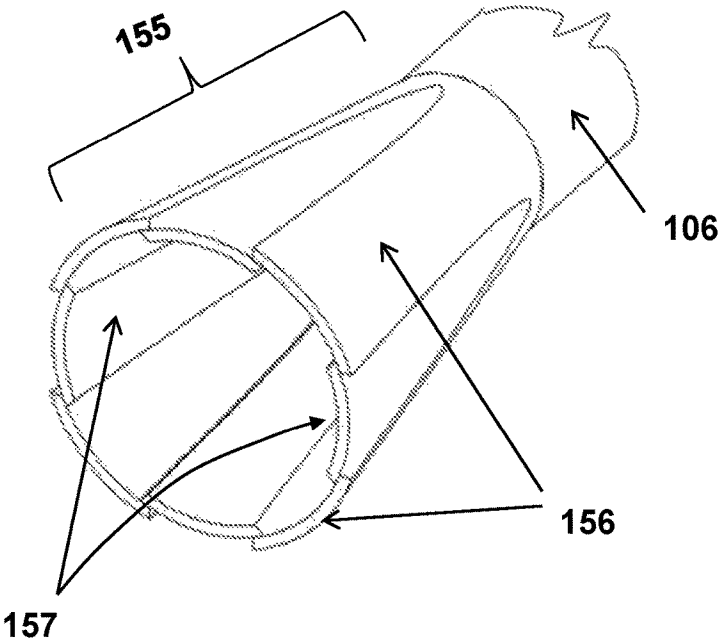
FIGS. 12A and 12B illustrates another alternative nozzle section design for the first embodiment of the countermeasure flare of FIG. 3.
Figure 12A:
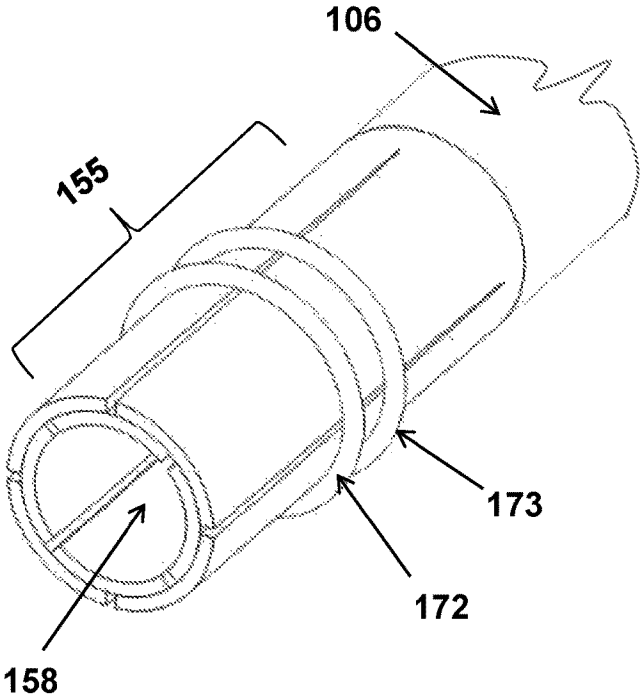

In the nozzles shown in FIGS. 3-10, the nozzle consists of a converging section, a throat section and a diverging (aft) section where the exiting gasses are accelerated. The diverging end section is provided to accelerate the gasses exiting the nozzle throat to generate higher levels of thrust. In flares, the diverging section may also have been provided to increase (radial) dispersion of the flare gasses, as for example, was shown in the embodiments of FIGS. 4 and 5. In certain flare applications, only a small level of thrust or even no thrust is required to be generated, thereby the nozzle section does not require minimal or no converging section to form the throat area and the diverging section is used mostly to provide for the aforementioned radial dispersion of the flare gasses passing through the nozzle. As an example and without intending to provide any limitation, an embodiment of such configuration transforming nozzles with circular cross-sectional area is shown schematically in FIGS. 12A and 12B. In this embodiment, the nozzle section 155 is constructed with at least two overlapping outer flaps 156 and inner flaps 157 as shown in FIG. 12B. In their first configuration, the flaps 156 and 157 are essentially straight and form an outer cylindrical surface that is the same as the outside surface of the shell structure 106 as shown in FIG. 12A. The flaps 156 and 157 are preferably brought from their second (not preloaded or "rest") configuration shown in FIG. 12B to their first configuration shown in FIG. 12A by deforming them elastically, and holding them in the latter state by strings or the like (not shown) that burn as the filling grain component 103 and/or other pyrotechnics and/or propellants in the space 158 inside nozzle section 155 are ignited upon ejection of the flare 100. Then as the flaps 156 and 157 are released, they would return to their aforementioned "rest" (not elastically preloaded) configuration of FIG. 12B, thereby transforming the section 152 into a diverging nozzle section.

In the embodiment of FIGS. 12A and 12B, the flaps 156 and 157 were described to assume a first configuration shown in FIG. 12A and upon ejection and the burning of the aforementioned strings or the like that are burned upon ejection, thereby allowing the flaps to assume their second configuration shown in FIG. 12B. It is, however, appreciated by those skilled in the art that almost all such deployable nozzles (such as those of the previous embodiments of the present invention) may be provided with the capability of assuming more than one deployed configuration. Such a capability can, for example, be readily achieved by providing more than one aforementioned "strings" or the like that hold the flaps 156 and 157 in their first configuration, but a first "string" or the like 172 (FIG. 12A) that once burned (released) would allow the deployment of the flaps 156 and 157 to a second configuration, and once a second "string" or the like 173 is "burned" (released), then the flaps 156 and 157 are deployed to a third (expanded nozzle) configuration, and so on if more than two such "strings" or the like are provided. The strings or the like can be burned sequentially by the burning of the flare filing grain component 103 and/or other pyrotechnics and/or propellants. Other means such as delay pyrotechnic burns.

Figure 13:
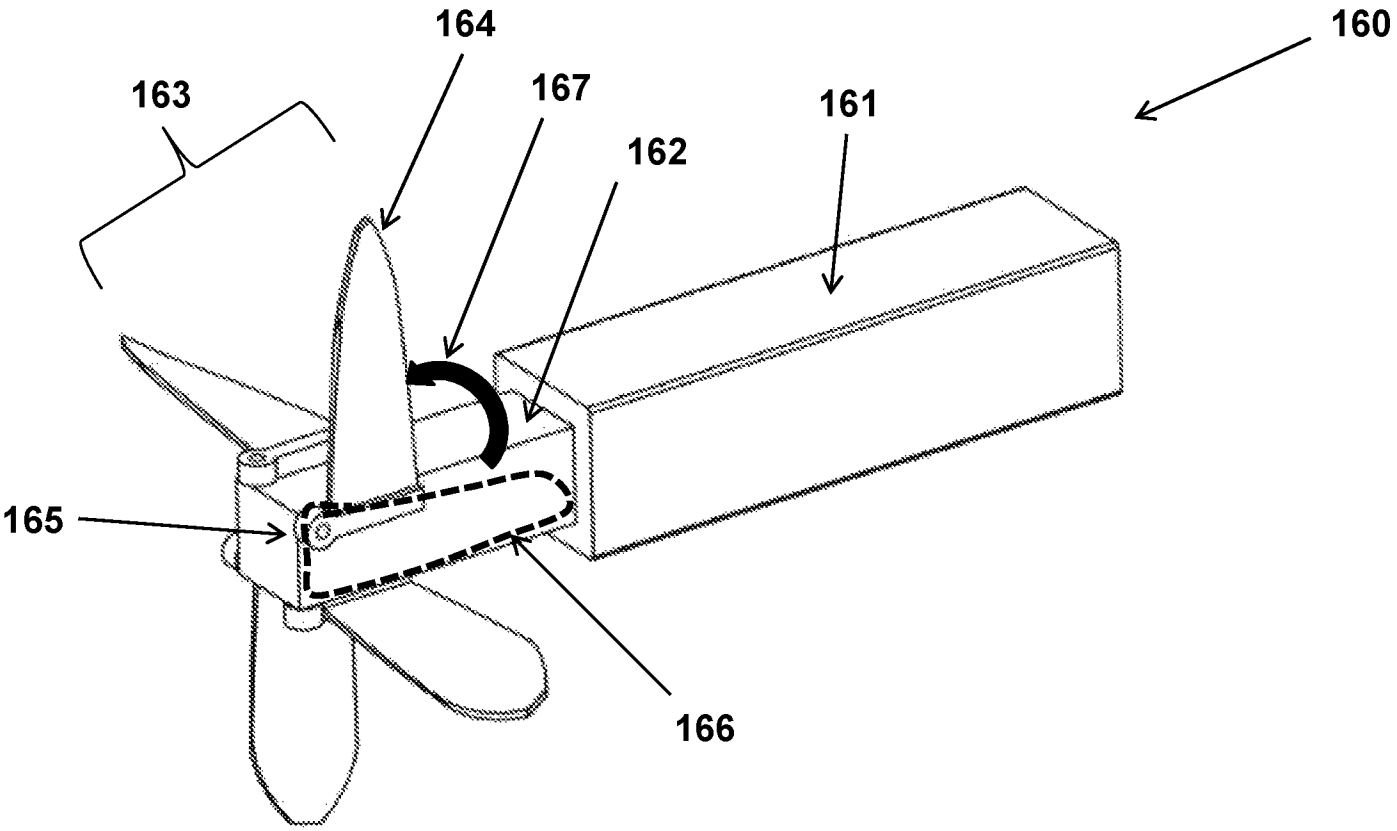
FIG. 13 is the schematic of an embodiment of the grain assembly of the countermeasure flare of the present invention that is provided with deployable fins for enhanced stability during the flight.

FIG. 13 illustrates the schematic of another embodiment 160 of the grain assembly (indicated 101 in the flare embodiment 100 of FIG. 3). The grain assembly 160 is to be similarly disposed within the casing 102 of the flare 100 shown in the schematic of FIG. 3. Similar to the flare embodiment 100, the casing 102 may have a first, aft end 104 and a second, opposite forward end 105 as shown in FIG. 3. The grain assembly 160 is similarly constructed with the shell structure 161, which is provided with a "step" 162 in its aft section 163, which is shaped and sized to accommodate at least one pair of deployable fins 164 described below (which can be symmetrically positioned along the long axis of the grain assembly 160). The shell structure 161, including the aft section 163, is similarly filled with grain component (similar to 103 in FIG. 3—not shown in FIG. 13), which consists of at least one combustible material and at least one reactive material which is positioned relative to the combustible material and configured to ignite combustion of the at least one combustible material. The grain component may also include at least one non-combustible material that is added to achieve certain effects such as generation and/or intensification of electromagnetic radiation at the desired wavelengths.

As indicated for the embodiment of FIG. 3, both the grain component 103 and the grain assembly 160 can have a (rectangular) or circular or near circular (oval) cross-sectional area, but may be almost of any shape. In the schematic of FIG. 13, the grain assembly 160 is considered to have a square cross-sectional area along the length of the grain assembly, including its aft section 163. It is, however, noted that the grain assembly may be provided with only one pair of fins 164, in which case the aft section 163 is only required to accommodate the pair of fins 164 and can therefore be constructed with steps only to accommodate the pair of fins 164.

The fins 164 are attached to the shell structure 161 with rotary joints 165. Before ejection, the fins 164 can each be held in the configuration 166 shown with dashed lines in FIG. 13 and assembled inside the casing 102 of the flare 100 shown in the schematic of FIG. 3. The fins 164 can each be held in their configuration 166 by strings or the like (not shown) that burn as the filling grain component 103 and/or other pyrotechnics and/or propellants in and around the aft section 163 of the flare are ignited. The fins 164 can also be provided with preloaded (preferably torsion springs acting at the rotary joints 165) that upon release, would rotate the fins from their stowed position 166 to their deployed configuration 164 as indicated by the arrow 167.

The main purpose for providing the flare 100 with the fins 164 in its aft section 163 is to generate a stabilizing drag as the flare travels along its flight trajectory following launch. It is appreciated by those skilled in the art that by varying the surface area and geometry of the fin and its angular orientation relative to the direction of the flight, the amount of generated drag can be varied. In general, the grain assembly 160 can have small fins to minimize the space that they are going to occupy within the casing 102 of the flare, FIGS. 3 and 13. In addition, the fins may also be used to cause the grain assembly 160 to start to spin along its long axis during the flight by tilting pairs of opposing fins 164 in the opposite directions similar to a propeller, thereby providing more stability to the grain assembly during the flight and thereby also reducing the size of the required fins.

Figure 14:
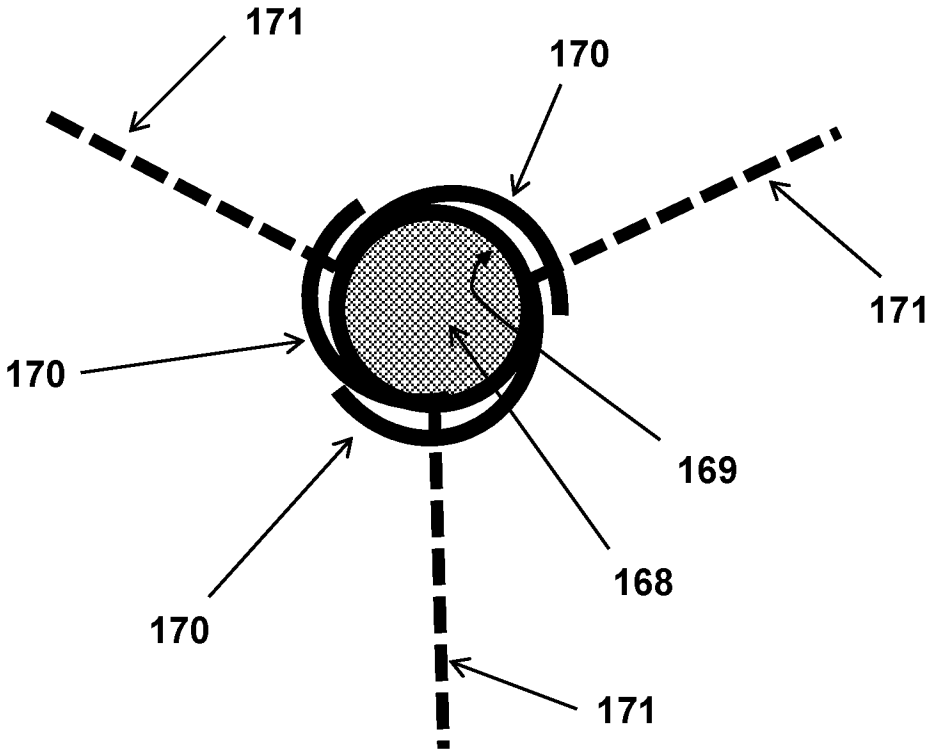
FIG. 14 is the schematic of another embodiment of the grain assembly of the countermeasure flare of the present invention that is provided with deployable fins for enhanced stability during the flight.

It is appreciated by those skilled in the art that other methods can also be used to provide deployable fins similar to the fins 164 of the grain assembly embodiment 160 of FIG. 13. For example, two or more fins may be designed to be deformed elastically and held in their first (un-deployed) configuration such that the resulting grain assembly could still fit within the casing 102 of the flare 100 shown in the schematic of FIG. 3, and then be deployed upon the grain assembly ejection. As an example and without intending to indicate any limitation, when the grain assembly has a circular cross-section as shown in FIG. 14, the fins may be "leaf spring" strip sections 170 that can be positioned symmetrically to the shell structure 169 and that in their first configuration are wound around the shell structure 169 of the aft section of the grain assembly 168. The wound fins 170 can be held in their configurations by strings or the like (not shown) that burn as the filling grain component 103 and/or other pyrotechnics and/or propellants in and around the aft section of the flare are ignited upon flare ejection. Then as the wound fins 170 are released following flare ejection, the fins unwind, and return to their "free" state 171 shown with dashed lines in FIG. 14. The fins can be rigidly attached to the shell structure 160, such as by welding or other similar methods. In their second configuration 171, the fins may be formed, oriented and positioned around the aft section of the shell structure 169 such that they would provide a pure drag force along the long axis of the flare for stability during the flight; or provide drag and a spinning torque along the long axis of the flare for increased stability during the flight and reduction of the required size of the fins; or for the stability during the flight and possibly to achieve certain other flight trajectories such as for example to achieve a helical flight path by providing the drag and torque along the long axis of the flare as well as a resultant lateral force.

In the embodiments of FIGS. 13 and 14, the shell structure 160 is provided with flight stabilizing fins that are deployed following flare ejection. It is appreciated by those skilled in the art that such fin stabilized flares can also be equipped with any one of the nozzles shown in the embodiments of FIGS. 3-12 for the purpose of generating thrust and/or means of generated gas dispersion or providing the means of achieving certain gas dispersion pattern.

In the flare embodiment 100 shown schematically in FIG. 3, the shell structure 106 is used to encase the entire length of the grain component 103 of the grain assembly 101, thereby limiting the exposed (burn) surface area of the grain component 103. As it was indicated previously, to increase the exposed surface area of the grain component 103, i.e., to increase the burn surface area of the grain component 103 and thereby increase its burn rate, the shell structure 106 may be eliminated forward certain distance from the aft section of the grain component, thereby exposing larger areas of the grain component 103 to combustion. The exposed (burn) surface area of the grain components may further be increased using the following embodiment 180 of the grain assembly 101.

Figure 15A:
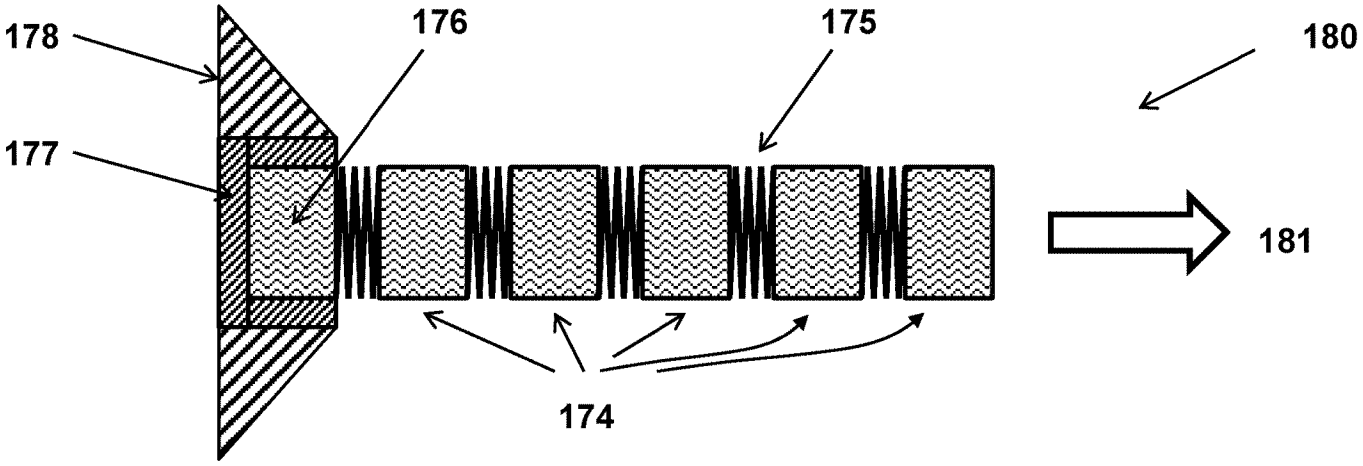
FIGS. 15A and 15B illustrate the schematic of another embodiment of the grain assembly of the countermeasure flare of the present invention that is provided with multi-sectional and axially expanding grain component to significantly increase the surface area of the grain upon ejection.

As can be seen in FIG. 3, the grain component 103 of the grain assembly is shown to be a solid component that even when only its aft section is encased in a shell structure 106, it would essentially stay as a solid element during the flare flight and burning. In the embodiment 180 shown schematically in FIG. 15, the grain component 103 is made out of at least two and preferably more sections 174 and 176 (in FIG. 15 into 6 sections), which are attached together by "expanding" elements 175 (in FIG. 15 shown as spring elements). In an embodiment, the aft section 176 is secured at least partially in the shortened aforementioned shell structure 177 (106 in FIG. 3), to which the deployable fins 178 such as those of the embodiments of FIG. 13 or 14 or the like are attached (in FIG. 15A, the fins 178 are shown in their deployed configuration). It is also appreciated by those skilled in the art that the shell assembly may also be provided with one of the previously disclosed nozzles to achieve one of the previously described effects; or alternatively be provided with a combination of deployable fins and nozzles; or alternatively with neither fins nor nozzles. Then following ejection, the elements 175 would "expand" and thereby separate the grain component sections 174 and 176 as shown in FIG. 15B, thereby significantly increasing the exposed surface area of the overall grain component, thereby allowing the burn rate of the grain component to be significantly increased.

Figure 15B:
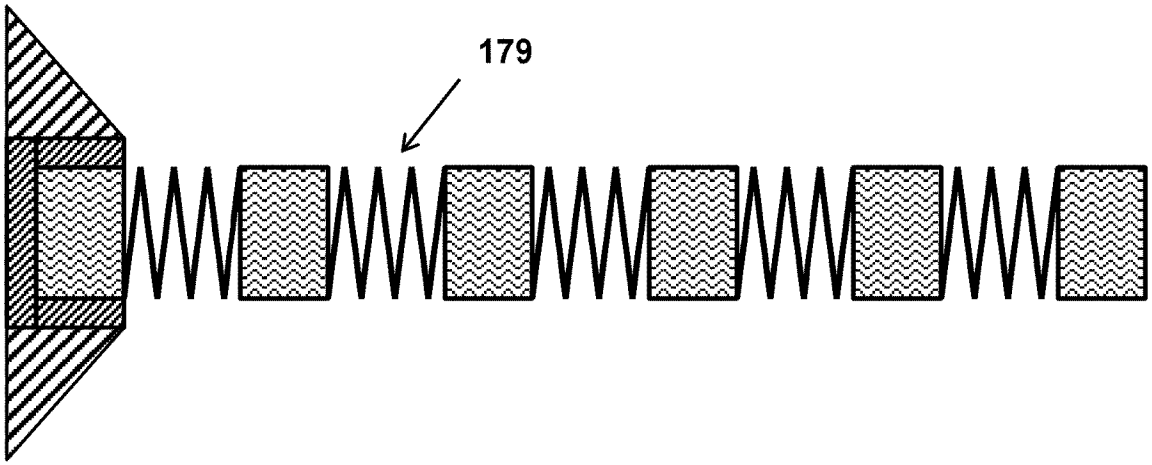
Figure 16B:
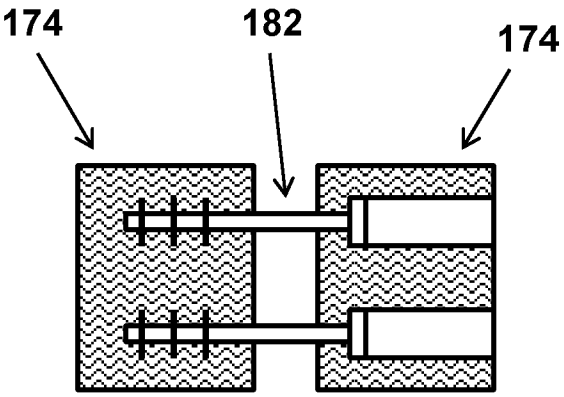
FIGS. 16A and 16B illustrate the schematic of an alternative assembly of the grain assembly of the countermeasure flare of the with multi-sectional and axially expanding grain component of FIGS. 15A and 15B.
Figure 16A:
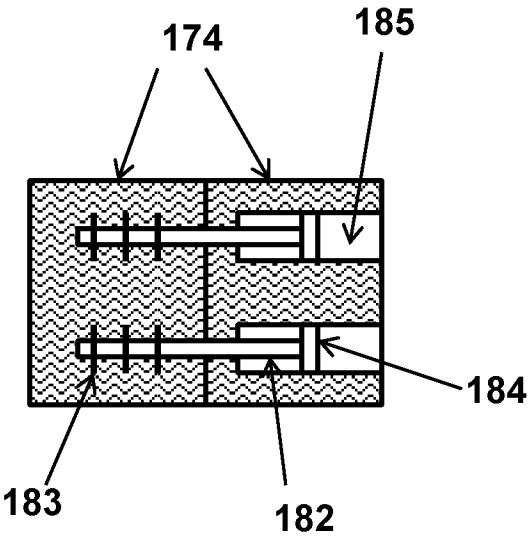

In the schematic of the embodiment 180 shown in FIGS. 15A and 15B, the "expanding" elements 175 are shown to be helical spring type elements, which can be preloaded in compression and held in said preloaded configuration by strings or the like (not shown) that burn as the grain component 103 is ignited following ejection, thereby releasing the spring type "expanding" elements 175, thereby separating the grain component sections 174 and 176 as shown in FIG. 15B. Alternatively, the "expanding" elements may in effect be "sliding joints" that allow relative axial translation between the adjacent grain component sections 174 and 176. For example and without intending any limitation, each pair of adjacent grain component sections 174 and 176, FIG. 15A, may be provided with a pair of pins 182, which are rigidly fixed to one of the grain component section as shown in FIGS. 16A and 16B, such as with anchoring protrusions 183 (in FIGS. 16 A and 16B to the left grain component section 174). The head 184 of the pair of pins are free to translate in the recesses 185 provided in the other (right hand) grain component section 174. This embodiment has the advantage of allowing the adjacent grain component sections 174 and 176 to come into contact, thereby maximizing the volume of the grain component in a flare. Then as the flare is ejected, the pairs of adjacent grain component sections 174 and 176 can be separated by allowing one (the right grain component section 174 in FIG. 16A) to separate from the other as shown in FIG. 16B. In an embodiment, the force required for "pulling" the adjacent grain component sections 174 and 176 apart is provided by the drag force generated by the fins 178 shown in FIGS. 15A and 15B. Otherwise, the pins 182 may be provided with springs (not shown) that are preloaded in compression in the pre-ejection configuration of FIG. 16A, and are positioned between the adjacent grain component sections 174 and 176 so that once the flare is ejected, the springs would force the right grain component section (FIGS. 16A and 16B) to translate over the pair of pins 182 and thereby separate the adjacent grain component sections as shown in FIG. 16B.

Figure 17A:
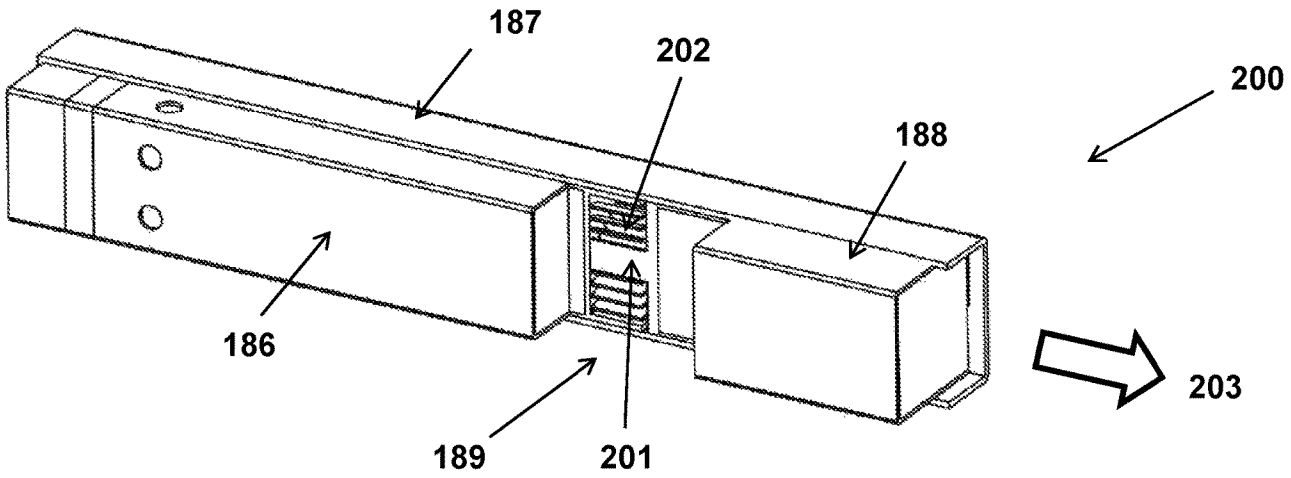
FIGS. 17A and 17B illustrate the schematic of another embodiment of the grain assembly of the countermeasure flare of flare of FIG. 3.
Figure 17B:
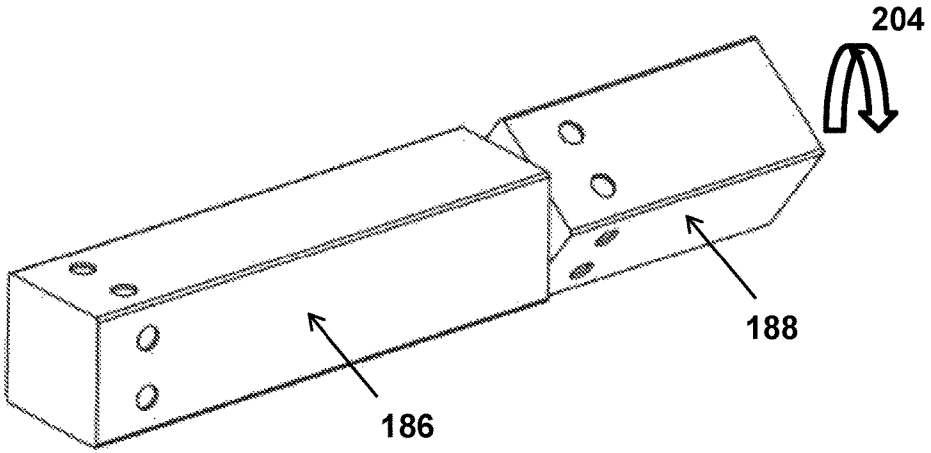

Another embodiment 200 of the grain assembly (indicated 101 in the flare embodiment 100 of FIG. 3) is shown in the schematics of FIGS. 17A and 17B. The grain assembly 200 is designed to provide flight stability following ejection by spinning of a section of the grain assembly as it is ejected from the casing 187 (102 in FIG. 3), shown sectioned so as to allow viewing of the interior components. The grain assembly 200 is to be similarly disposed within the casing 187 as shown in the schematics of FIGS. 17A and 17B of the flare 100 shown in the schematic of FIG. 3. Similar to the flare embodiment 100, the casing 187 may have a first, aft end 104 and a second, opposite forward end 105 as shown in FIG. 3. The grain assembly 200 is constructed with at least two sections 186 and 188. The at least two sections 186 and 188 are connected together by a rotary joint with the shaft of the joint 201 shown in the cutaway section 189 of FIG. 17A, thereby allowing free relative rotation between the at least two sections 186 and 188 about the long axis of the grain assembly 200. The rotary joint is provided with a torsion spring 202 (such as a power type spring) which is attached to the section 186 (188) on one side (such as at the inner spring turn) and its other (such as outside) end pushing against the (such as the inner) provided recess in the other section 188 (186). Then before assembling the grain assembly 200 inside the flare casing 187, the section 186 is rotated relative to the section 188 in the direction of preloading the torsion spring 202. Then as the grain assembly 200 is ejected out of the flare casing 187 (in the direction of the arrow 203, FIG. 17A), as the grain assembly section 188 exits the flare casing 187, the preloaded torsion spring 202 will cause the exited section 188 to begin to spin in the direction of the arrow 204 relative to the (rotation constrained) section 186. Thus, as the entire grain assembly 200 is ejected, the "frontal" section 188 of the grain assembly 200 is provided with a flight stabilizing spin.

Figure 18B:
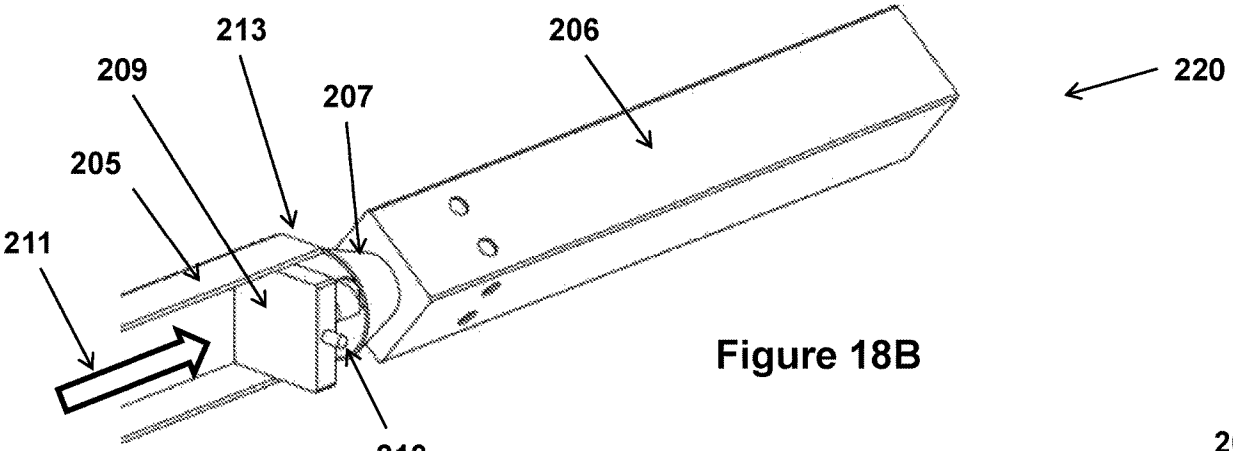
FIGS. 18A, 18B and 18C illustrate the schematic of another embodiment of the grain assembly of the countermeasure flare of flare of FIG. 3 and its various components.
Figure 18C:
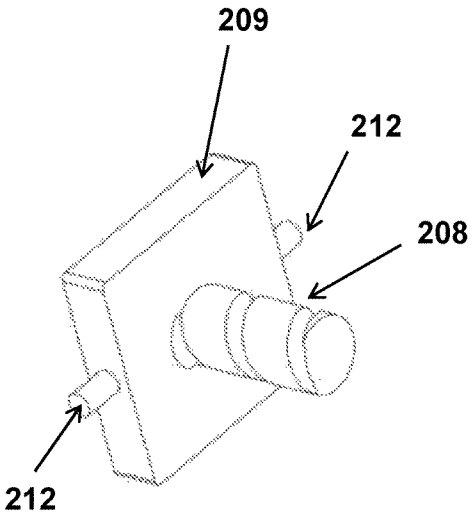
Figure 18A:
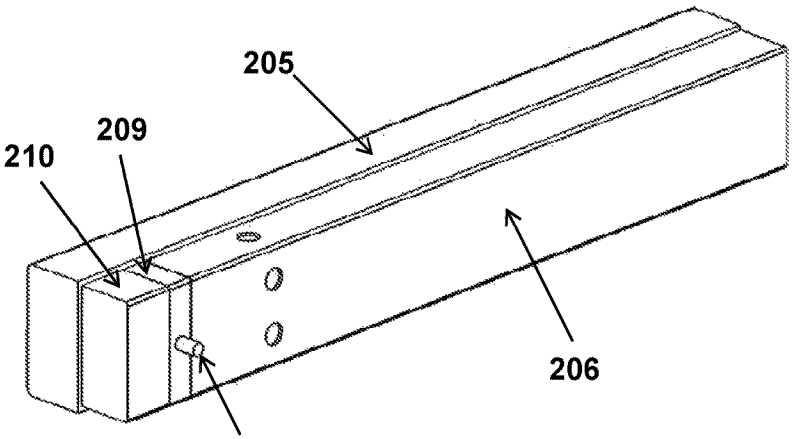

Another embodiment 220 of the grain assembly (indicated 101 in the flare embodiment 100 of FIG. 3) is shown in the schematics of FIGS. 18A and 18B. The grain assembly 220 is to be similarly disposed within the casing 205 (102 in the schematic of FIG. 3) (shown sectioned so as to allow viewing of the interior components) as shown in the schematic of FIG. 18A of the flare 100 (shown in the schematic of FIG. 3). The grain assembly 220 is designed to provide flight stability following ejection by the spinning of the grain assembly as it is ejected from the casing 205 as shown in FIG. 18B. Similar to the flare embodiment 100, the casing 205 may have a first, aft end 104 and a second, opposite forward end 105 as shown in FIG. 3. On its aft end, the grain component 206 is provided with an embedded "nut" element 207 (which may also form the throat and expanding portion of a nozzle as shown in FIG. 18B). In its assembled configuration shown in FIG. 18B, the "nut" element 207 is engaged with the "bolt" portion 208 (FIG. 18C) of the "spin" element 209 (FIGS. 18B and 18C). In FIG. 18A, the element 210 is considered to represent the combination of the flare impulse charge device and the piston member (elements 109 and 110 in the schematic of FIG. 3, respectively). It is, however, appreciated by those skilled in the art that the "spin" element 209 may also be used to serve as the piston member of the flare (i.e., the piston member 110 in FIG. 3). Then as the grain assembly 220 is being ejected from the casing 205 following the initiation of the aforementioned impulse charge device, i.e., as the "spin" element 209 is translated in the direction of the arrow 211 as shown in FIG. 18B. The "spin" element 209 is provided with guiding steps or pins or the like 212 that ride in the provided matching recess guide (not shown) inside the casing 205, which ends close to the forward end 213 of the casing 205. As a result, when the "spin" element 209 (together with the grain component 206) reaches the forward end 213 of the casing 205 and the aforementioned guide in which the guiding steps 212 are riding ends, the "spin" element 209 would come to a sudden stop. At this point, the grain component 206 has already gained the prescribed speed and thereby momentum, which would force the "nut" element 207 to begin to turn and translate in the direction of grain component 206 travel, i.e., in the direction of releasing the "nut" element 207. As a result, the grain component 206 is forced to spin about its long axis, thereby providing it with a flight stabilizing spin. The described mechanism of spin generation is similar to that of gun rifling, with the difference that in the present case the barrel (the "nut" element 207) is translating instead of the bullet (the "bolt" portion 208) in the gun.

It is appreciated by those skilled in the art that the spin rate that is achieved by the grain component 206 is dependent on the exit velocity of the grain component and the pitch of the mating "bolt" portion 208 and the "nut" element" 207. In addition, in an alternative design, the guiding steps or pins or the like 212 may be eliminated and instead the forward end 213 be provided with a very slight inward "lips" (not shown) that are provided to prevent the "spin" element 209 to exit the casing 205.

Figure 19A:
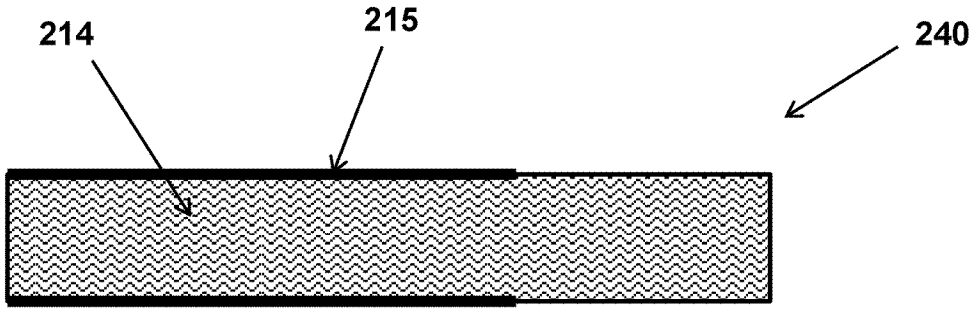
FIGS. 19A and 19B illustrate the schematic of another embodiment of the grain assembly of the countermeasure flare of flare of FIG. 3.
Figure 19B:
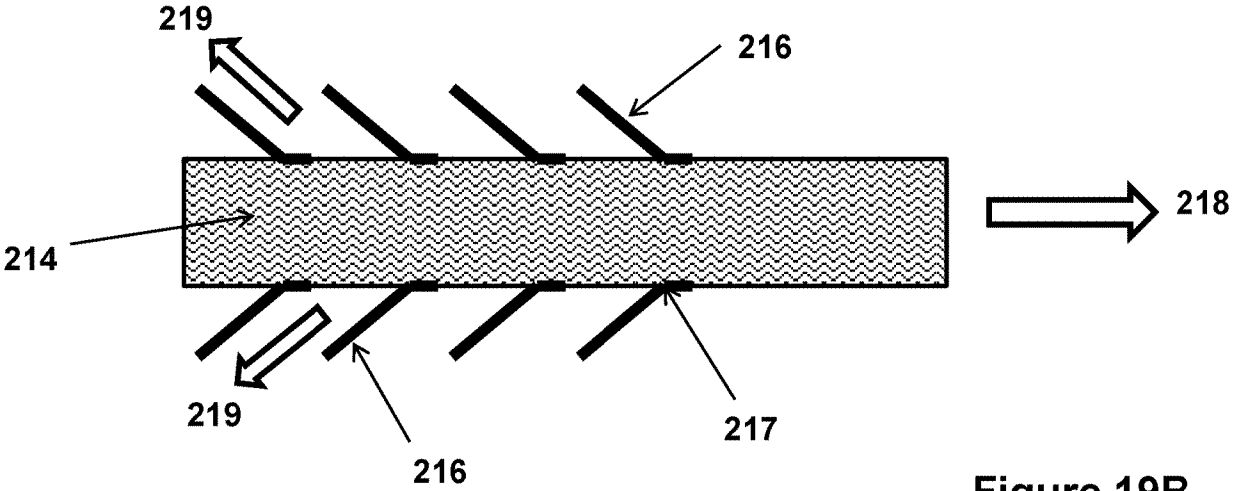

Another embodiment 240 of the grain assembly (indicated 101 in the flare embodiment 100 of FIG. 3) is shown in the schematics of FIGS. 19A and 19B. In FIGS. 19A and 19B, the longitudinal cross-sectional view of the grain assembly 240 is illustrated. In the embodiment 240, at least a portion of the grain component 214 is encased in the shell structure 215. On portions, such as the facing sides of the shell structure 215, portions of the shell structure 215 are cut out and provided with panels 216 that can be attached to the shell structure 215 via living rotary joints 217, which can be preloaded in torsion to rotate the panels 216 to their free configuration shown in FIG. 19B. The panels 216 can be held in their preloaded configuration shown in FIG. 19A by strings or the like (not shown) that burn as the filling grain component 214 inside the shell structure is ignited. Thus, as the grain assembly 240 is ejected in the direction of the arrow 218 from the casing 102 (FIG. 3), the strings or the like burn and the panels 216 open into the configuration shown in FIG. 19B. In general, the panels 216 are desired to be as large as possible to maximize the exposed surface area (burn area) of the grain component 214. The gasses generated by the burning grain component 214 under the panels 216 openings will then be forced to exit at an angle as shown by the arrow 219, thereby generating an axial thrust in the direction of the grain assembly travel shown by the arrow 218.

Figure 20B:
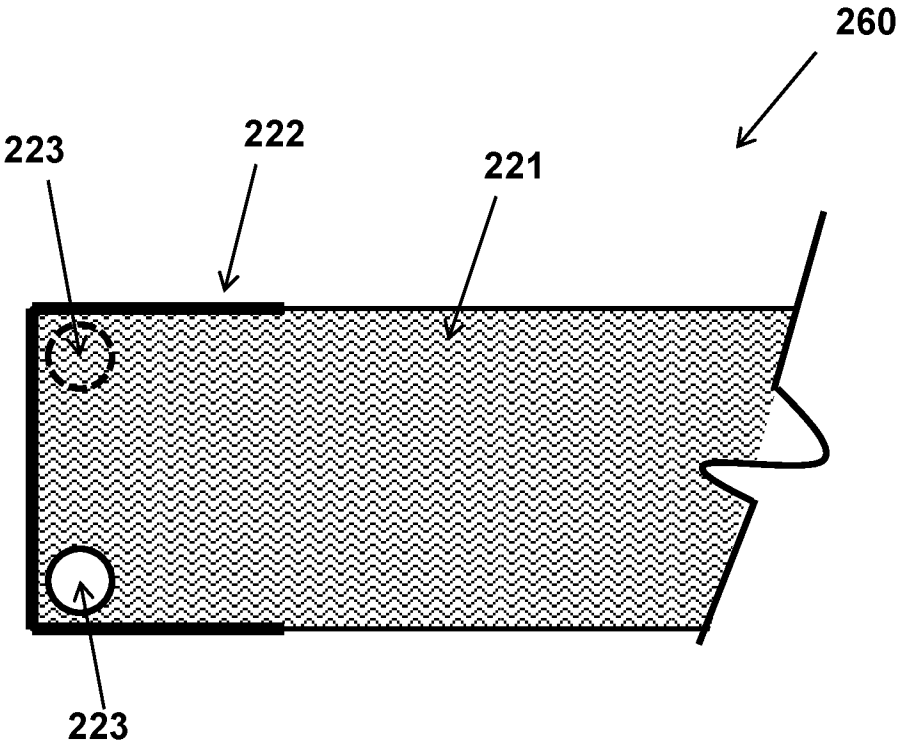
FIGS. 20A and 20B illustrate the schematic of another embodiment of the grain assembly of the countermeasure flare of flare of FIG. 3.
Figure 20A:
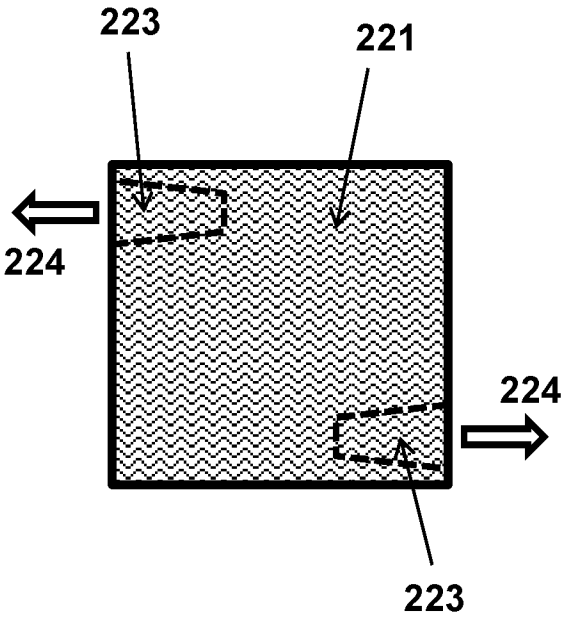

Another embodiment 260 of the grain assembly (indicated 101 in the flare embodiment 100 of FIG. 3) is shown in the schematics of FIGS. 20A and 20B. In FIG. 20B, the longitudinal cross-section of a section (in this case the aft section) of the grain assembly 260 is shown, illustrating a section of the grain component 221, with at least a portion of the grain component 221 being encased in the shell structure 222. FIG. 20A is the aft view of the grain assembly 260. The grain assembly 260 is provided with at least two impulse generating elements 223 (thrusters with or without nozzles with converging and throat and possibly a diverging section or impulse generators that generate impulse by ejection of solid mass(es) or the like). The impulse generating elements can generate nearly identical impulse levels and are positioned symmetrical relative to the long axis of the grain assembly 260 with the direction of the generated impulse (shown by the arrows 224 in FIG. 20A) being all directed in the direction of spinning the grain assembly 260 clockwise as shown in FIG. 20A or counterclockwise to provide the grain assembly 260 with flight stability. The impulse generating elements 223 can be activated as soon as the grain assembly is ejected.

In the schematic of FIG. 20B and for the sake of simplicity, the impulse generating elements 223 are shown to be positioned near the aft section of the grain assembly 260. It is, however, appreciated by those skilled in the art that that said impulse generating elements 223 can be positioned close to the center of mass of the grain assembly 260 to minimize the chances of the grain assembly to be also rotated (tumbled) upon activation of the impulse generating elements 223.

In the embodiments 200, 220, 240 and 260 shown in FIGS. 17, 18, 19 and 20, respectively, such embodiments are shown without any of the aforementioned nozzles (such as those shown schematically in FIGS. 3-12 or deployable fins (such as those shown schematically in FIG. 13 or 14) or the like nozzles and/or fins. It is, however, appreciated by those skilled in the art that any one of the disclosed grain assembly embodiments of FIGS. 15 and 17-19 may be provided with one of the aforementioned nozzles and/or fins or the like nozzles and/or fins.

In the embodiments of FIGS. 3-13 and 17-19, the shell structures (for example shell structure 106 in FIG. 3-12 or 161 in FIG. 13, etc.) are shown to be constructed solid sheets of relatively rigid material such as aluminum, plastic or cardboard or the like. However, it is appreciated by those skilled in the art that the shell structure may also be provided with holes of various shapes and sizes to increase the exposed surface area of the grain components to increase the grain component burn rate. Alternatively, at least portions of the shell structure may be made out of nettings woven with relatively thin metal fibers to maximize the exposed surface area of the grain components to significantly increase the grain component burn rate.

In the aforementioned embodiments, the deployable nozzles (such as those of the embodiments of FIGS. 4-12) or the deployable fins (such as those of the embodiments of FIGS. 13-4), or the deployable panels 216 of the embodiment of FIG. 19 are indicated to be deployed at or shortly after flare ejection. Alternatively, the ejected grain assemblies may be provided with (such as pyrotechnic type) delay fuzes such that one or more nozzle/fin/panel deployment could be made a predetermined amount of time following flare ejection.

Figure 21A:
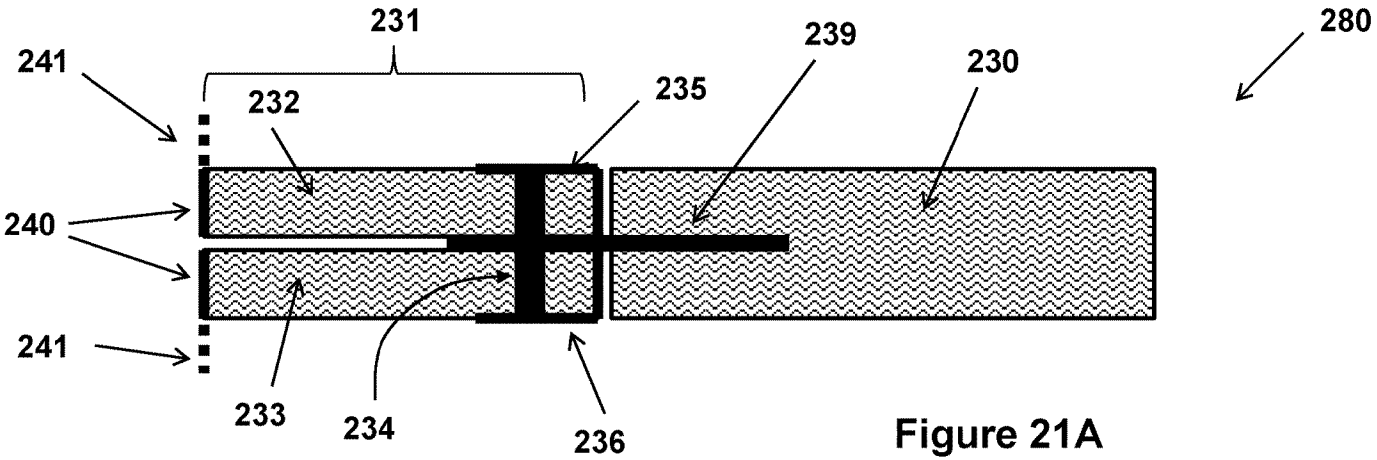
FIGS. 21A and 21B illustrate the schematic of another embodiment of the grain assembly of the countermeasure flare of FIG. 3.
Figure 21B:
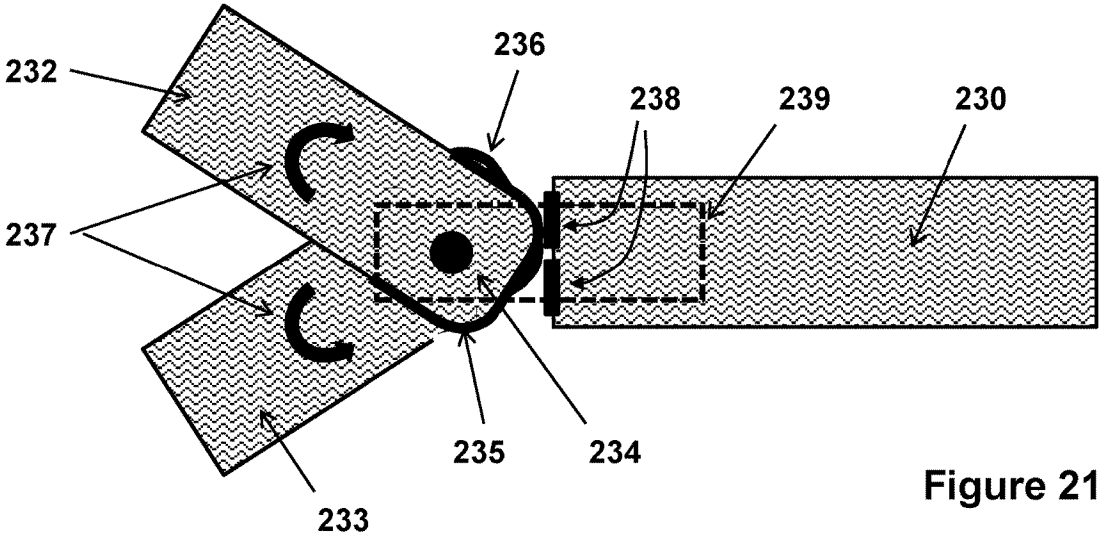

Another embodiment 280 of the grain assembly (indicated 101 in the flare embodiment 100 of FIG. 3) is shown in the schematics of FIGS. 21A and 21B. In FIG. 21A the longitudinal cross-sectional view of the grain assembly 280 is illustrated. In the embodiment 280, at least a portion of the aft section 231 of the grain component 230 consists of at least two sections 232 and 233. The two sections 232 and 233 of the grain component 230 are attached together by a pin joint 234 such that following flare ejection, they could rotate relative to each other as shown in the side view of FIG. 21B. The two sections 232 and 233 can be provided with reinforcing casing 235 and 236, respectively, that allow the rotation of the two sections 232 and 233 about the pin joint 234. Before ejection, the grain assembly 280 is inside the shell structure (106 in the schematic of FIG. 3) and the two sections 232 and 233 are lined up along the length of the front portion of the grain component 230 (the grain component 230 is intended to include the at least two sections 232 and 233). Then as the grain assembly is ejected, torsion springs (not shown) provided on each of the at least two sections 232 and 233 would force the said to rotate outwards as shown by the arrows 237, to bring them to the configurations shown in FIG. 21B. The at least two sections 232 and 233 are provided with stops 238 to limit their rotation in the direction of the arrows 237 to a prescribed angle. Reinforcing intermediate plate(s) or the like may be inserted in the front portion of the grain component 230 to the extension of which the pin 234 is preferably attached.

It is appreciated by those skilled in the art that the aforementioned at least two sections 232 and 233 of the grain component 230 may assume any desired (lengthwise) portion of the grain component 230. In fact the entire grain component 230 may be divided into at least two such sections and made to rotate as shown in FIG. 21B upon flare ejection.

It is also appreciated by those skilled in the art that upon ejection of the flare, since the two sections 232 and 233 are positioned on opposite sides of the longitudinal axis of symmetry of the grain component 230, their generated aerodynamic drag would tend to generate a spinning torque on the grain component 230 during the flight. As a result, the outward rotation of the at least two sections 232 and 233 and the generated spinning of the grain component 230 (which includes the at least two sections 232 and 233) would result on the gasses generated by the burning grain component 230 to be dispersed further out. In addition, the generated spinning of the grain component will provide a stabilizing effect on the flare during its flight.

It is also appreciated by those skilled in the art that by adding additional deployable aerodynamic drag/lift generating surfaces from the at least two sections 232 and 233, the amount of spinning torque acting about the longitudinal axis of symmetry of the grain component 230 can be increased, thereby increasing the spin rate of the flare during the flight. As an example and without intending to provide any limitation, the deployable aerodynamic drag/lift generating surfaces (elements) may be those indicated by the numeral 240 in the schematic of FIG. 21A. The elements can be provided with biasing springs (not shown) or the like such that after flare ejection, they would deploy to the position 241 shown with dashed lines in the schematic of FIG. 21A.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A flare comprising:

a casing; and a grain assembly, at least a portion the grain assembly being slidably disposed in the casing, the grain assembly comprising:

a shell structure; and a grain component at least partially disposed in the shell structure, the grain component including at least one combustible material and at least one reactive material positioned relative to the combustible material and configured to ignite combustion of the at least one combustible material;

wherein the shell structure includes one or more nozzles at an aft end of the shell structure for generating a thrust resulting from ignition of the at least one combustible material; and the one or more nozzles are restrained in a first shape inside the casing and configured to have a second shape, different from the first shape, when the restraint is removed.

2. The flare of claim 1, further comprising:

an impulse charge device positioned at an aft end of the casing; and a piston positioned between at least a portion of the one or more nozzle and the impulse charge device such that pressurized gasses generated by initiation of the impulse charge device act on the piston, which in turn ejects the grain assembly from a forward end of the casing.

3. The flare of claim 2, further comprising an end cap positioned at the forward end of the casing to seal the grain assembly inside the casing.

4. The flare of claim 1, wherein each of the one or more nozzles include a throat portion and at least one of a expanding portion and a diverging portion connected to the throat.

5. The flare of claim 1, wherein the one or more nozzle are restrained in the first shape by a mechanical restraint.

6. The flare of claim 1, wherein the one or more nozzles are restrained in the first shape by a combustible material filling an area inside the one or more nozzles.

7. The flare of claim 1, wherein the one or more nozzles are restrained in the first shape by a resiliency in the material forming the one or more nozzles.

8. The flare of claim 1, wherein the one or more nozzles are restrained in the first shape by one or more biasing members.

9. A flare comprising:

a casing; and a grain assembly, at least a portion the grain assembly being slidably disposed in the casing, the grain assembly comprising:

a shell structure; and a grain component at least partially disposed in the shell structure, the grain component including at least one combustible material and at least one reactive material positioned relative to the combustible material and configured to ignite combustion of the at least one combustible material;

wherein the shell structure includes one or more nozzles at an aft end of the shell structure for generating a thrust resulting from ignition of the at least one combustible material;

wherein the one or more nozzles comprises two nozzles, each configured to direct thrust in a different direction.

* * * * *